US010029837B2

(12) United States Patent
Alexander et al.

(10) Patent No.: US 10,029,837 B2
(45) Date of Patent: Jul. 24, 2018

(54) CARTON WITH ARTICLE PROTECTION INSERT

(71) Applicant: Graphic Packaging International, Inc., Atlanta, GA (US)

(72) Inventors: O'Neal Alexander, Covington, GA (US); Raymond R. Spivey, Sr., Mableton, GA (US); Mark Baldino, Marietta, GA (US); Ana Gonzalez, Igualada (ES); John Murdick Holley, Jr., Lawrenceville, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 12 days.

(21) Appl. No.: 15/146,298

(22) Filed: May 4, 2016

(65) Prior Publication Data

US 2016/0244231 A1 Aug. 25, 2016

Related U.S. Application Data

(62) Division of application No. 13/832,886, filed on Mar. 15, 2013, now Pat. No. 9,352,890.

(Continued)

(51) Int. Cl.

*B65D 71/40* (2006.01)
*B65D 5/50* (2006.01)

(Continued)

(52) U.S. Cl.

CPC ..... *B65D 71/16* (2013.01); *B65B 5/024* (2013.01); *B65B 5/10* (2013.01); *B65B 21/02* (2013.01);

(Continued)

(58) Field of Classification Search

CPC .. B65D 2571/0032; B65D 2571/00401; B65D 2571/00808; B65D 2571/00814;

(Continued)

(56) References Cited

U.S. PATENT DOCUMENTS 1,925,102 A 9/1933 Levkoff
2,005,924 A 6/1935 Wilson (Continued)

FOREIGN PATENT DOCUMENTS

CA 873185 6/1971
DE 299 13 585 U1 10/1999

(Continued)

OTHER PUBLICATIONS

International Search Report and Written Opinion for PCT/US2013/031886 dated Jun. 21, 2013.

(Continued)

*Primary Examiner* — J. Gregory Pickett
*Assistant Examiner* — Allan Stevens
(74) *Attorney, Agent, or Firm* — Womble Bond Dickinson (US) LLP

(57) ABSTRACT

A carton for containing at least one article. The carton includes a plurality of panels at least partially forming an interior of the carton. The plurality of panels includes a top panel. The carton includes an article protection flap foldably connected to at least one panel of the plurality of panels. The article protection flap is moveable between a first position that is substantially parallel to the top panel and a second position wherein the article protection flap is folded relative to the top panel. The at least one access feature in the top panel is for positioning the article protection flap from the first position to the second position.

34 Claims, 21 Drawing Sheets

Related U.S. Application Data

(60) Provisional application No. 61/741,315, filed on Jul. 17, 2012.

(51) Int. Cl.

| | |
|---|---|
| ***B65D 71/16*** | (2006.01) |
| ***B65B 5/02*** | (2006.01) |
| ***B65B 5/10*** | (2006.01) |
| ***B65D 5/42*** | (2006.01) |
| ***B65D 5/468*** | (2006.01) |
| ***B65D 85/20*** | (2006.01) |
| ***B65D 71/36*** | (2006.01) |
| ***B65D 71/32*** | (2006.01) |
| ***B65D 5/72*** | (2006.01) |
| ***B65B 21/02*** | (2006.01) |
| ***B65B 61/20*** | (2006.01) |
| ***B65D 71/38*** | (2006.01) |

(52) U.S. Cl.

CPC ..... *B65B 61/20* (2013.01); *B65D 5/42* (2013.01); *B65D 5/4608* (2013.01); *B65D 5/5026* (2013.01); *B65D 5/5059* (2013.01); *B65D 5/727* (2013.01); *B65D 71/32* (2013.01); *B65D 71/36* (2013.01); *B65D 71/38* (2013.01); *B65D 71/403* (2013.01); *B65D 85/20* (2013.01); *B65D 2571/0032* (2013.01); *B65D 2571/0045* (2013.01); *B65D 2571/0066* (2013.01); *B65D 2571/00141* (2013.01); *B65D 2571/00265* (2013.01); *B65D 2571/00271* (2013.01); *B65D 2571/00314* (2013.01); *B65D 2571/00574* (2013.01); *B65D 2571/00728* (2013.01)

(58) Field of Classification Search

CPC ..... B65D 71/70; B65D 71/72; B65D 71/403; B65D 71/42; B65D 71/506; B65D 71/504; B65D 5/5038; B65D 5/5059; B65D 5/5064; B65D 5/5061

USPC ..... 206/433, 199, 152, 197, 174–179, 194

See application file for complete search history.

(56) References Cited

U.S. PATENT DOCUMENTS

| | | | |
|---|---|---|---|
| 2,067,749 | A | 1/1937 | Zimmerman et al. |
| 2,115,673 | A | 4/1938 | Stompe |
| 2,196,502 | A | 4/1940 | Kells |
| 2,299,027 | A | 10/1942 | Novak |
| 2,386,905 | A | 10/1945 | Meitzen |
| 2,648,484 | A | 8/1953 | Belsinger |
| 2,669,351 | A | 2/1954 | Carson et al. |
| 2,754,047 | A | 7/1956 | Schmidt et al. |
| 2,877,894 | A | 3/1959 | Forrer |
| 3,078,032 | A | 2/1963 | Robinson et al. |
| 3,128,010 | A | 4/1964 | Forrer |
| 3,133,634 | A | 5/1964 | Bozdar |
| 3,152,688 | A | 10/1964 | Mahon |
| 3,167,214 | A | 1/1965 | Mahon |
| 3,173,596 | A | 3/1965 | Aust et al. |
| 3,176,902 | A | 4/1965 | Champlin |
| 3,178,242 | A | 4/1965 | Ellis et al. |
| 3,228,582 | A | 1/1966 | Osberg |
| 3,252,649 | A | 5/1966 | Graser et al. |
| 3,255,919 | A | 6/1966 | Koolnis |
| 3,263,861 | A | 8/1966 | Carr |
| 3,265,283 | A | 8/1966 | Farquhar |
| 3,300,115 | A | 1/1967 | Schauer |
| 3,332,594 | A | 7/1967 | De Capua |
| 3,346,167 | A | 10/1967 | Schmidt |
| 3,355,012 | A | 11/1967 | Weiss |
| 3,356,279 | A | 12/1967 | Root |
| 3,367,557 | A | 2/1968 | Farquhar |
| 3,386,570 | A | 6/1968 | Lock |
| 3,432,029 | A | 3/1969 | Brown |
| 3,517,858 | A | 6/1970 | Farquhar |
| 3,533,549 | A | 10/1970 | Gilchrist |
| 3,540,581 | A | 11/1970 | Koolnis |
| 3,669,342 | A | 6/1972 | Funkhouser |
| 3,670,950 | A | 6/1972 | Rossi |
| 3,679,121 | A | 7/1972 | Morgese |
| 3,687,282 | A | 8/1972 | Owen |
| 3,715,029 | A | 2/1973 | Wood |
| 3,747,801 | A | 7/1973 | Graser |
| 3,767,042 | A | 10/1973 | Ganz |
| 3,797,729 | A | 3/1974 | Holmes |
| 3,825,170 | A | 7/1974 | Aust et al. |
| 3,904,036 | A | 9/1975 | Forrer |
| 3,921,895 | A | 11/1975 | Ziche |
| 3,942,631 | A | 3/1976 | Sutherland et al. |
| 3,963,121 | A | 6/1976 | Kipp |
| 3,977,518 | A | 8/1976 | Arneson |
| 4,012,887 | A | 3/1977 | Calvert et al. |
| 4,034,852 | A | 7/1977 | Forrer |
| 4,056,223 | A | 11/1977 | Williams |
| 4,093,068 | A | 6/1978 | Smrt |
| 4,101,069 | A | 7/1978 | Wood |
| 4,131,230 | A | 12/1978 | Koehlinger et al. |
| 4,146,168 | A | 3/1979 | Hartline |
| 4,155,449 | A | 5/1979 | Bryne |
| 4,186,867 | A | 2/1980 | Wood |
| 4,194,682 | A | 3/1980 | Congleton |
| 4,202,446 | A | 5/1980 | Sutherland |
| 4,214,660 | A | 7/1980 | Hunt, Jr. |
| 4,222,485 | A | 9/1980 | Focke |
| 4,234,081 | A | 11/1980 | Champlin |
| 4,256,226 | A | 3/1981 | Stone |
| 4,295,562 | A | 10/1981 | Wood |
| 4,318,474 | A | 3/1982 | Hasegawa |
| 4,324,328 | A | 4/1982 | Champlin |
| 4,328,891 | A | 5/1982 | Elward |
| 4,330,079 | A | 5/1982 | Wood |
| 4,364,509 | A | 12/1982 | Holley, Jr. et al. |
| 4,375,258 | A | 3/1983 | Crayne et al. |
| 4,376,509 | A | 3/1983 | Schaffer |
| 4,378,877 | A | 4/1983 | Botterman et al. |
| 4,394,903 | A | 7/1983 | Bakx |
| 4,396,143 | A | 8/1983 | Killy |
| 4,398,631 | A | 8/1983 | Graser |
| 4,417,655 | A | 11/1983 | Forbes, Jr. |
| 4,417,661 | A | 11/1983 | Roccaforte |
| 4,421,232 | A | 12/1983 | Konaka |
| 4,424,901 | A | 1/1984 | Lanier |
| 4,437,569 | A | 3/1984 | Sorenson |
| 4,437,606 | A | 3/1984 | Graser |
| 4,438,843 | A | 3/1984 | Graser |
| 4,463,852 | A | 8/1984 | Stone |
| 4,465,180 | A | 8/1984 | Klygis |
| 4,470,503 | A | 9/1984 | Stone |
| 4,498,618 | A | 2/1985 | Sutherland |
| 4,505,696 | A | 3/1985 | Wright et al. |
| 4,533,047 | A | 8/1985 | Calvert |
| 4,538,759 | A | 9/1985 | Dutcher |
| 4,545,485 | A | 10/1985 | Oliff |
| 4,574,997 | A | 3/1986 | Ikeda |
| 4,577,762 | A | 3/1986 | Kuchenbecker |
| 4,588,084 | A | 5/1986 | Holley, Jr. |
| 4,597,523 | A | 7/1986 | Schuster |
| 4,600,140 | A | 7/1986 | Milliens |
| 4,605,128 | A | 8/1986 | Rieke |
| 4,621,766 | A | 11/1986 | McClure |
| 4,658,984 | A | 4/1987 | Brunner |
| 4,708,284 | A | 11/1987 | Sutherland et al. |
| 4,757,938 | A | 7/1988 | Collins |
| 4,773,533 | A | 9/1988 | Greene |
| 4,817,866 | A | 4/1989 | Wonnacott |
| 4,830,267 | A | 5/1989 | Wilson |
| 4,883,168 | A | 11/1989 | Dreyfus |
| 4,890,440 | A | 1/1990 | Romagnoli |
| 4,890,737 | A | 1/1990 | Kadleck et al. |
| 4,890,738 | A | 1/1990 | Carer |

(56) References Cited

U.S. PATENT DOCUMENTS

| | | | |
|---|---|---|---|
| 4,919,266 | A | 4/1990 | McIntosh, Jr. et al. |
| 4,925,019 | A | 5/1990 | Ganz et al. |
| 4,949,845 | A | 8/1990 | Dixon |
| 4,967,901 | A | 11/1990 | Wood |
| 4,974,771 | A | 12/1990 | Lavery |
| 5,002,186 | A | 3/1991 | Cooper |
| D316,672 | S | 5/1991 | Wood |
| 5,020,668 | A | 6/1991 | Schuster |
| 5,022,525 | A | 6/1991 | Schuster |
| 5,072,876 | A | 12/1991 | Wilson |
| 5,080,280 | A | 1/1992 | Kraus |
| 5,101,642 | A | 4/1992 | Alexandrov |
| 5,119,985 | A | 6/1992 | Dawson et al. |
| 5,131,588 | A | 7/1992 | Oliff |
| 5,137,211 | A | 8/1992 | Summer et al. |
| 5,145,067 | A | 9/1992 | Carver |
| 5,158,177 | A | 10/1992 | Negelen et al. |
| 5,167,325 | A | 12/1992 | Sykora |
| 5,219,229 | A | 6/1993 | Sengewald |
| 5,246,112 | A | 9/1993 | Stout et al. |
| 5,249,681 | A | 10/1993 | Miller |
| 5,297,673 | A | 3/1994 | Sutherland |
| 5,297,725 | A | 3/1994 | Sutherland |
| 5,310,050 | A | 5/1994 | Sutherland |
| 5,311,984 | A | 5/1994 | Harris |
| 5,320,277 | A | 6/1994 | Stout et al. |
| 5,323,895 | A | 6/1994 | Sutherland |
| 5,328,080 | A | 7/1994 | Holley, Jr. |
| 5,333,734 | A | 8/1994 | Stout et al. |
| 5,350,109 | A | 9/1994 | Brown et al. |
| 5,360,104 | A | 11/1994 | Sutherland |
| 5,360,113 | A | 11/1994 | Harris |
| 5,385,234 | A | 1/1995 | Stout et al. |
| 5,390,784 | A | 2/1995 | Sutherland |
| 5,390,848 | A | 2/1995 | Gungner et al. |
| 5,425,474 | A | 6/1995 | Dalea et al. |
| 5,437,363 | A | 8/1995 | Gungner |
| 5,439,110 | A | 8/1995 | Regan, II |
| 5,439,112 | A | 8/1995 | De Guglielmo et al. |
| 5,443,203 | A | 8/1995 | Sutherland |
| 5,472,090 | A | 12/1995 | Sutherland |
| 5,476,217 | A | 12/1995 | Moncrief et al. |
| 5,482,185 | A | 1/1996 | McNaughton |
| 5,482,203 | A | 1/1996 | Stout |
| 5,503,324 | A | 4/1996 | Bacchetti et al. |
| 5,505,372 | A | 4/1996 | Edson et al. |
| 5,549,197 | A | 8/1996 | Sutherland |
| 5,577,612 | A | 11/1996 | Chesson et al. |
| 5,579,904 | A | 12/1996 | Holley, Jr. |
| 5,582,289 | A | 12/1996 | Wright |
| 5,588,585 | A | 12/1996 | McClure |
| 5,595,291 | A | 1/1997 | Negelen |
| 5,595,292 | A | 1/1997 | Bates |
| 5,595,299 | A | 1/1997 | LeBras |
| 5,597,114 | A | 1/1997 | Kramedjian et al. |
| 5,605,228 | A | 2/1997 | Baxter |
| 5,611,431 | A | 3/1997 | Harris |
| 5,622,309 | A | 4/1997 | Matsuda et al. |
| 5,653,340 | A | 8/1997 | Daniel |
| 5,664,683 | A | 9/1997 | Brody |
| 5,671,845 | A | 9/1997 | Harris |
| 5,690,213 | A | 11/1997 | Matsumura |
| 5,690,230 | A | 11/1997 | Griffith |
| 5,699,957 | A | 12/1997 | Blin et al. |
| 5,765,685 | A | 6/1998 | Roosa |
| 5,775,572 | A | 7/1998 | Oliff |
| 5,794,778 | A | 8/1998 | Harris |
| 5,826,783 | A | 10/1998 | Stout |
| 5,873,516 | A | 2/1999 | Boggs |
| 5,875,961 | A | 3/1999 | Stone et al. |
| 5,881,884 | A | 3/1999 | Podosek |
| 5,921,398 | A | 7/1999 | Carroll |
| 5,924,559 | A | 7/1999 | Carrel et al. |
| 5,927,498 | A | 7/1999 | Saam |
| 5,941,389 | A | 8/1999 | Gomes |
| 5,947,367 | A | 9/1999 | Miller et al. |
| 5,975,286 | A | 11/1999 | Oliff |
| 5,975,287 | A | 11/1999 | Negelen |
| 5,979,645 | A | 11/1999 | Holley, Jr. |
| 5,984,086 | A | 11/1999 | Fousghee et al. |
| 6,050,402 | A | 4/2000 | Walter |
| 6,155,412 | A | 12/2000 | LeBras et al. |
| 6,170,741 | B1 | 1/2001 | Skolik et al. |
| 6,176,419 | B1 | 1/2001 | Holley, Jr. |
| 6,189,687 | B1 | 2/2001 | Bakx |
| 6,213,297 | B1 | 4/2001 | Gale |
| 6,241,083 | B1 | 6/2001 | Harrelson |
| 6,247,585 | B1 | 6/2001 | Holley, Jr. |
| 6,250,542 | B1 | 6/2001 | Negelen |
| 6,273,330 | B1 | 8/2001 | Oliff et al. |
| 6,283,293 | B1 | 9/2001 | Lingamfelter |
| 6,295,789 | B1 | 10/2001 | Muller |
| 6,302,320 | B1 | 10/2001 | Stout |
| 6,315,111 | B1 | 11/2001 | Sutherland |
| 6,315,123 | B1 | 11/2001 | Ikeda |
| 6,409,077 | B1 | 6/2002 | Telesca et al. |
| D459,927 | S | 7/2002 | Flowers et al. |
| 6,471,120 | B1 | 10/2002 | Vogel |
| 6,478,219 | B1 | 11/2002 | Holley, Jr. |
| 6,484,903 | B2 | 11/2002 | Spivey et al. |
| 6,536,656 | B2 | 3/2003 | Auclair et al. |
| 6,550,615 | B2 | 4/2003 | Lingamfelter |
| 6,557,699 | B1 | 5/2003 | Focke et al. |
| 6,578,736 | B2 | 6/2003 | Spivey |
| 6,604,677 | B1 | 8/2003 | Sutherland et al. |
| 6,615,984 | B2 | 9/2003 | Saulas et al. |
| 6,631,803 | B2 | 10/2003 | Rhodes et al. |
| 6,669,083 | B2 | 12/2003 | Bates |
| 6,695,137 | B2 | 2/2004 | Jones et al. |
| 6,715,639 | B2 | 4/2004 | Spivey |
| 6,752,262 | B1 | 6/2004 | Boriani et al. |
| 6,789,673 | B2 | 9/2004 | Lingamfelter |
| 6,848,573 | B2 | 2/2005 | Gould et al. |
| 6,866,186 | B2 | 3/2005 | Fogle et al. |
| 6,877,600 | B2 | 4/2005 | Sutherland |
| 6,896,130 | B2 | 5/2005 | Theelen |
| 6,902,104 | B2 | 6/2005 | Holley, Jr. et al. |
| 6,918,487 | B2 | 7/2005 | Harrelson |
| 6,926,193 | B2 | 8/2005 | Smalley |
| 6,929,172 | B2 | 8/2005 | Bates et al. |
| 6,932,265 | B2 | 8/2005 | Sax et al. |
| 6,948,293 | B1 | 9/2005 | Eckermann et al. |
| 6,968,992 | B2 | 11/2005 | Schuster |
| 6,974,072 | B2 | 12/2005 | Harrelson |
| 6,983,874 | B2 | 1/2006 | Bakx |
| 6,991,107 | B2 | 1/2006 | Harrelson |
| 6,997,316 | B2 | 2/2006 | Sutherland |
| 6,997,372 | B2 | 2/2006 | Gasparowicz |
| 7,000,803 | B2 | 2/2006 | Miller |
| 7,028,839 | B2 | 4/2006 | Belloli et al. |
| 7,048,113 | B2 | 5/2006 | Gomes |
| 7,063,208 | B2 | 6/2006 | Lebras |
| 7,070,045 | B2 | 7/2006 | Theelen |
| 7,073,665 | B2 | 7/2006 | Auclair et al. |
| 7,104,435 | B2 | 9/2006 | Holley, Jr. |
| 7,134,547 | B2 | 11/2006 | Auclair |
| 7,134,593 | B2 | 11/2006 | Harrelson |
| 7,159,759 | B2 | 1/2007 | Sutherland |
| 7,175,020 | B2 | 2/2007 | Sutherland et al. |
| 7,225,930 | B2 | 6/2007 | Ford et al. |
| 7,234,591 | B2 | 6/2007 | LeBras et al. |
| 7,360,647 | B2 | 4/2008 | Ogg |
| 7,374,038 | B2 | 5/2008 | Smalley |
| 7,422,104 | B2 | 9/2008 | Perkinson |
| 7,427,010 | B2 | 9/2008 | Sutherland |
| 7,467,729 | B2 | 12/2008 | Lown et al. |
| 7,478,743 | B2 | 1/2009 | Holley, Jr. |
| 7,604,157 | B2 | 10/2009 | Zammit et al. |
| 7,690,507 | B2 | 4/2010 | Sutherland |
| 7,699,215 | B2 | 4/2010 | Spivey, Sr. |
| 7,780,067 | B2 | 8/2010 | Holley, Jr. |
| 7,913,844 | B2 | 3/2011 | Spivey, Sr. |
| 8,061,587 | B2 | 11/2011 | Blin |
| 8,070,052 | B2 | 12/2011 | Spivey, Sr. |

(56) References Cited

U.S. PATENT DOCUMENTS

| | | | | |
|---|---|---|---|---|
| 8,459,534 | B2 | 6/2013 | Bradford | |
| 9,352,890 | B2 | 5/2016 | Alexander et al. | |
| 2002/0029991 | A1 | 3/2002 | Lingamfelter | |
| 2002/0070139 | A1 | 6/2002 | Bates | |
| 2002/0088820 | A1 | 7/2002 | Spivey | |
| 2002/0088821 | A1 | 7/2002 | Spivey et al. | |
| 2002/0185499 | A1 | 12/2002 | Harrelson et al. | |
| 2003/0006158 | A1 | 1/2003 | Skolik et al. | |
| 2003/0136820 | A1 | 7/2003 | Negelen | |
| 2003/0141313 | A1 | 7/2003 | Bates | |
| 2003/0150759 | A1 | 8/2003 | White, Jr. | |
| 2003/0192907 | A1 | 10/2003 | Bates | |
| 2004/0000494 | A1 | 1/2004 | Sutherland | |
| 2004/0040334 | A1 | 3/2004 | Rusnock | |
| 2004/0060972 | A1 | 4/2004 | Harrelson | |
| 2004/0089575 | A1 | 5/2004 | Lingamfelter | |
| 2004/0089671 | A1 | 5/2004 | Miller | |
| 2004/0099558 | A1 | 5/2004 | Oliff et al. | |
| 2004/0155098 | A1 | 8/2004 | Harrelson | |
| 2004/0164135 | A1 | 8/2004 | Gong et al. | |
| 2004/0188277 | A1 | 9/2004 | Auclair | |
| 2004/0188300 | A1 | 9/2004 | Sutherland | |
| 2004/0188508 | A1 | 9/2004 | Holley, Jr. et al. | |
| 2005/0023170 | A1 | 2/2005 | Lingamfelter | |
| 2005/0092820 | A1 | 5/2005 | Chekroune | |
| 2005/0115843 | A1 | 6/2005 | Harrelson | |
| 2005/0126947 | A1 | 6/2005 | Holley, Jr. | |
| 2005/0150783 | A1* | 7/2005 | Ogg | B65D 5/28 206/193 |
| 2005/0167291 | A1 | 8/2005 | Sutherland | |
| 2005/0167478 | A1 | 8/2005 | Holley, Jr. | |
| 2005/0189405 | A1 | 9/2005 | Gomes et al. | |
| 2005/0263574 | A1 | 12/2005 | Schuster | |
| 2006/0054522 | A1 | 3/2006 | Kline et al. | |
| 2006/0081691 | A1 | 4/2006 | Smalley | |
| 2006/0091193 | A1 | 5/2006 | DeBusk | |
| 2006/0118606 | A1 | 6/2006 | Holley, Jr. et al. | |
| 2006/0131370 | A1 | 6/2006 | Bates | |
| 2006/0175386 | A1 | 8/2006 | Holley, Jr. | |
| 2006/0231441 | A1 | 10/2006 | Gomes et al. | |
| 2006/0231600 | A1 | 10/2006 | Holley | |
| 2006/0249413 | A1 | 11/2006 | Auclair et al. | |
| 2006/0278689 | A1 | 12/2006 | Boshinski et al. | |
| 2006/0283723 | A1 | 12/2006 | Bates et al. | |
| 2007/0007325 | A1 | 1/2007 | Suzuki et al. | |
| 2007/0029371 | A1 | 2/2007 | Theelen | |
| 2007/0056869 | A1 | 3/2007 | Tokarski | |
| 2007/0108261 | A1 | 5/2007 | Schuster | |
| 2007/0131748 | A1 | 6/2007 | Brand | |
| 2007/0164093 | A1 | 7/2007 | Spivey et al. | |
| 2007/0181658 | A1 | 8/2007 | Sutherland | |
| 2007/0205255 | A1 | 9/2007 | Dunn | |
| 2007/0210144 | A1 | 9/2007 | Brand | |
| 2007/0215682 | A1 | 9/2007 | Bates et al. | |
| 2007/0251982 | A1 | 11/2007 | Brand | |
| 2007/0277481 | A1 | 12/2007 | LeBras | |
| 2007/0295790 | A1 | 12/2007 | Zammit et al. | |
| 2008/0023535 | A1 | 1/2008 | Holley, Jr. | |
| 2008/0048014 | A1 | 2/2008 | Bates | |
| 2008/0128479 | A1 | 6/2008 | Bates | |
| 2008/0257942 | A1 | 10/2008 | LeBras | |
| 2008/0257943 | A1 | 10/2008 | Blin | |
| 2009/0032425 | A1 | 2/2009 | Perkinson | |
| 2009/0065559 | A1 | 3/2009 | Parkes | |
| 2009/0236408 | A1 | 9/2009 | Spivey, Sr. et al. | |
| 2009/0282843 | A1 | 11/2009 | Brand | |
| 2010/0044420 | A1 | 2/2010 | Brand et al. | |
| 2010/0122999 | A1 | 5/2010 | Brand | |
| 2010/0140336 | A1 | 6/2010 | Ho Fung | |
| 2010/0237138 | A1 | 9/2010 | Bradford | |
| 2011/0011924 | A1 | 1/2011 | Spivey et al. | |
| 2011/0049228 | A1 | 3/2011 | Brand | |
| 2011/0065558 | A1 | 3/2011 | Smalley | |
| 2011/0233091 | A1 | 9/2011 | Block et al. | |
| 2011/0284622 | A1 | 11/2011 | Boukredine | |
| 2011/0290692 | A1 | 12/2011 | Spivey, Sr. | |
| 2011/0290867 | A1 | 12/2011 | Schemmel et al. | |
| 2012/0279897 | A1 | 11/2012 | Schmal et al. | |

FOREIGN PATENT DOCUMENTS

| | | | | |
|---|---|---|---|---|
| EP | 0 024 782 | A1 | 3/1981 | |
| EP | 0 066 029 | | 12/1982 | |
| EP | 332 153 | B1 | 9/1991 | |
| EP | 630 825 | A2 | 12/1994 | |
| EP | 0 576 640 | B1 | 1/1998 | |
| EP | 0 901 969 | B1 | 4/2000 | |
| EP | 1 065 151 | A1 | 1/2001 | |
| EP | 1 433 714 | | 6/2004 | |
| EP | 1 103 481 | B1 | 8/2004 | |
| EP | 1 010 637 | B1 | 9/2004 | |
| EP | 1 125 858 | B1 | 9/2004 | |
| EP | 1 381 545 | B1 | 10/2005 | |
| EP | 1 334 043 | B1 | 12/2005 | |
| EP | 1 151 935 | B1 | 8/2006 | |
| EP | 1 698 565 | | 9/2006 | |
| EP | 1 513 737 | B1 | 11/2006 | |
| EP | 2 055 648 | A1 | 5/2009 | |
| EP | 1 749 755 | B1 | 12/2011 | |
| FR | 2 549 010 | | 1/1985 | |
| GB | 109527 | A * | 9/1917 | B65D 5/48026 |
| GB | 2 264 101 | | 8/1993 | |
| JP | 9-2525 | | 1/1997 | |
| JP | 11-124129 | A | 5/1999 | |
| JP | 3039805 | | 3/2000 | |
| JP | 2001-10662 | | 1/2001 | |
| JP | 2002-128064 | | 5/2002 | |
| JP | 2006-111342 | | 4/2006 | |
| JP | 2007-055630 | | 3/2007 | |
| JP | 2007-204059 | A | 8/2007 | |
| JP | 2007 0532421 | | 11/2007 | |
| JP | 2008 213894 | A | 9/2008 | |
| JP | 2009-120248 | | 6/2009 | |
| JP | 2010-83532 | | 4/2010 | |
| JP | 2010-149927 | | 7/2010 | |
| KR | 10-0154124 | | 2/1999 | |
| KR | 10-0371048 | | 8/2003 | |
| KR | 20-2010-0010124 | | 10/2010 | |
| WO | WO 92/09498 | | 6/1992 | |
| WO | WO 93/14991 | A1 | 8/1993 | |
| WO | WO 95/08489 | A1 | 3/1995 | |
| WO | WO 96/21603 | | 7/1996 | |
| WO | WO 96/29260 | | 9/1996 | |
| WO | WO 99/28198 | | 6/1999 | |
| WO | WO 99/64301 | | 12/1999 | |
| WO | WO 00/03937 | | 1/2000 | |
| WO | WO 02/47990 | | 6/2002 | |
| WO | WO 2004/043790 | | 5/2004 | |
| WO | WO 2005/042370 | A1 | 5/2005 | |
| WO | WO 2005/051781 | | 6/2005 | |
| WO | WO 2005/100175 | | 10/2005 | |
| WO | WO 2006/050210 | | 5/2006 | |
| WO | WO 2006/050316 | | 5/2006 | |
| WO | WO 2007/076544 | | 7/2007 | |
| WO | WO 2011/022145 | A1 | 2/2011 | |
| WO | WO 2011/049947 | A1 | 4/2011 | |

OTHER PUBLICATIONS

Supplementary European Search Report for EP 13 81 9732 dated Nov. 10, 2015.

Office Action for U.S. Appl. No. 13/832,886, dated Jul. 15, 2014.

Response to Restriction Requirement for U.S. Appl. No. 13/832,886, dated Aug. 15, 2014.

Office Action for U.S. Appl. No. 13/832,886, dated Dec. 5, 2014.

Amendment A and Response to Office Action for U.S. Appl. No. 13/832,886, dated Mar. 5, 2015.

Office Action for U.S. Appl. No. 13/832,886, dated Mar. 26, 2015.

Request for Continued Examination (RCE) Transmittal for U.S. Appl. No. 13/832,886, dated Jun. 16, 2015.

Amendment B and Response to Final Office Action for U.S. Appl. No. 13/832,886, dated Jun. 16, 2015.

(56) References Cited

OTHER PUBLICATIONS

Office Action for U.S. Appl. No. 13/832,886, dated Aug. 28, 2015.
Amendment C and Response to Office Action for U.S. Appl. No. 13/832,886, dated Nov. 23, 2015.
Notice of Allowance and Fee(s) Due for U.S. Appl. No. 13/832,886, dated Feb. 4, 2016.
Issue Fee Transmittal Form for U.S. Appl. No. 13/832,886, dated May 4, 2016.
Issue Notification for U.S. Appl. No. 13/832,886, dated May 11, 2016.

* cited by examiner

CARTON WITH ARTICLE PROTECTION INSERT

CROSS-REFERENCE TO RELATED APPLICATIONS

This application is a divisional of U.S. patent application Ser. No. 13/832,886, filed Mar. 15, 2013, which claims the benefit of U.S. Provisional Patent Application No. 61/741,315, filed Jul. 17, 2012. This application is related to U.S. patent application Ser. No. 13/419,740, filed Mar. 14, 2012, which claims the benefit of U.S. Provisional Application No. 61/518,504, filed May 6, 2011, U.S. Provisional Application No. 61/572,638, filed Jul. 19, 2011, U.S. Provisional Application No. 61/272,249, filed Oct. 7, 2011, U.S. Provisional Application No. 61/548,779, filed Oct. 19, 2011, and U.S. Provisional Application No. 61/570,044, filed Dec. 13, 2011.

INCORPORATION BY REFERENCE

The entire contents of U.S. patent application Ser. No. 13/832,886, filed Mar. 15, 2013, U.S. Provisional Patent Application No. 61/741,315, filed Jul. 17, 2012, U.S. patent application Ser. No. 13/419,740, filed Mar. 14, 2012, U.S. Provisional Application No. 61/518,504, filed May 6, 2011, U.S. Provisional Application No. 61/572,638, filed Jul. 19, 2011, U.S. Provisional Application No. 61/272,249, filed Oct. 7, 2011, U.S. Provisional Application No. 61/548,779, filed Oct. 19, 2011, and U.S. Provisional Application No. 61/570,044, filed Dec. 13, 2011, are hereby incorporated by reference as if presented herein in their entirety.

BACKGROUND OF THE DISCLOSURE

The present disclosure generally relates to cartons for holding beverage containers or other types of articles. More specifically, the present disclosure relates to cartons having an article protection insert and access features for positioning the article protection insert.

SUMMARY OF THE DISCLOSURE

In general, one aspect of the disclosure is generally directed to a carton for containing a plurality of articles. The carton comprises a plurality of panels that extends at least partially around an interior of the carton, the plurality of panels comprising a top panel, a bottom panel, a first side panel, and a second side panel. An article protection insert comprises a plurality of features for engaging a respective article of the plurality of articles. At least one access feature is in the top panel for positioning the article protection insert to a position wherein the features engage at least one article of the plurality of articles.

In another aspect, the disclosure is generally directed to a combination of a carton blank and an article protection insert blank for forming a carton for containing a plurality of articles. The carton blank comprises a plurality of panels comprising a top panel, a bottom panel, a first side panel, and a second side panel, and at least one access feature in the top panel for positioning the article protection insert blank. The article protection insert blank comprises a plurality of features for engaging a respective article of the plurality of articles. The at least one access feature is for positioning the article protection insert to a position wherein the features engage at least one article of the plurality of articles in the carton formed from carton blank and the article protection insert blank.

In another aspect, the disclosure is generally directed to a method of forming a carton. The method comprises obtaining a carton blank comprising a plurality of panels comprising a top panel, a bottom panel, a first side panel, and a second side panel, and at least one access feature in the top panel. The method comprises obtaining an article protection insert blank comprising a plurality of features for engaging a respective article of the plurality of articles and positioning the article protection insert blank relative to the carton blank. The method comprises forming an interior of the carton at least partially defined by the plurality of panels, the forming the interior of the carton comprising forming an open-ended sleeve, loading a plurality of articles in the interior of the carton, and accessing the article protection insert blank through the at least one access feature to form the article protection insert with the features in engagement with a respective article of the plurality of articles.

Other aspects, features, and details of the present disclosure can be more completely understood by reference to the following detailed description of exemplary embodiments taken in conjunction with the drawings and from the appended claims.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to protection, opening, dispensing, and handling features for cartons that contain articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Some of the various features disclosed may be similar to any of the embodiments disclosed in the above-noted incorporated by reference patent applications, including U.S. patent application Ser. No. 13/419,740 and all related applications. Further, some of the various features disclosed herein may be combined with features disclosed in the '740 application to restrain movement of the containers in the carton.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "lower," "bottom," "upper" and "top" indicate orientations determined in relation to fully erected and upright cartons.

Figure 1:
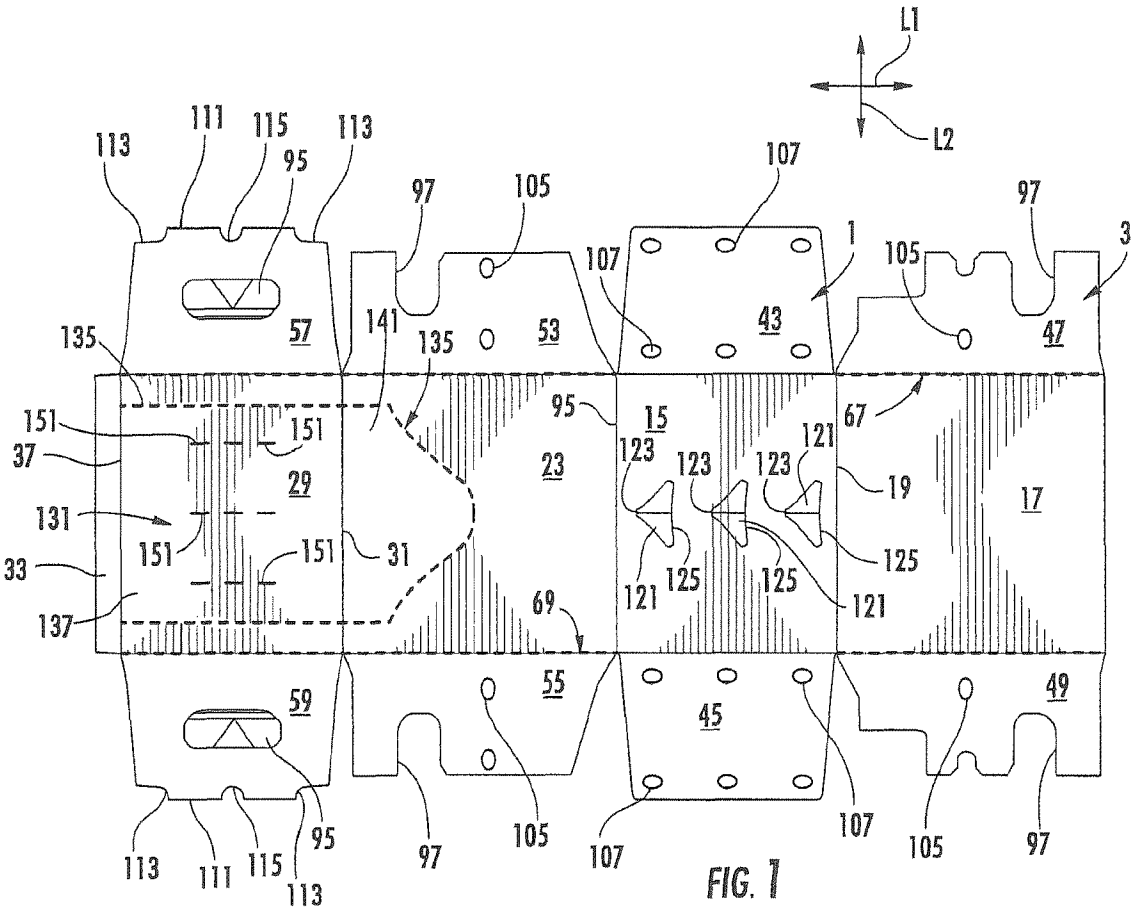
FIG. 1 is a plan view of an exterior surface of a carton blank according to a first exemplary embodiment of the disclosure.
Figure 5:
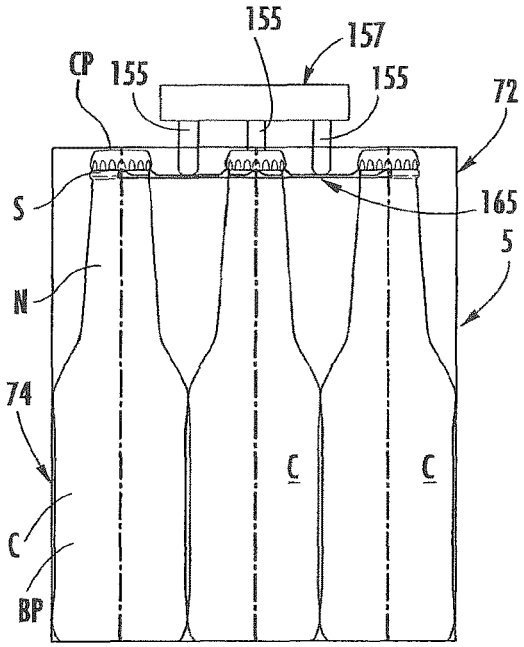
FIG. 5 is a side schematic view of the carton of FIG. 3 with a carton forming machine positioning an article protection insert to a first position.

FIG. 1 is a plan view of the exterior side 1 of a blank, generally indicated at 3, used to form a carton 5 (FIG. 3) according to a first exemplary embodiment of the disclosure. The carton 5 can be used to house a plurality of articles such as containers C (FIG. 5). In the illustrated embodiment, the containers C are bottles having a wide bottom portion BP, an upper portion or neck N extending upwardly from the bottom portion BP, a cap CP at the top of each container C, and a shoulder S just below the cap. In the illustrated embodiment, the carton 5 is sized to house twelve containers C in a single layer in a 3×4 arrangement, but it is understood that the carton 5 may be sized and shaped to hold containers C of a different or same quantity in more than one layer and/or in different row/column arrangements (e.g., 1×6, 3×6, 2×6, 2×6×2, 3×4×2, 2×9, 4×3, etc.). The containers C could be otherwise shaped, arranged, and/or configured without departing from the disclosure. For example, the containers C could be beverage cans or other containers. In the illustrated embodiment, the carton 5 includes a handle, generally indicated at 11 (FIG. 3), for grasping and carrying the carton.

The blank 3 has a longitudinal axis L1 and a lateral axis L2. In the illustrated embodiment, the blank 3 comprises a bottom panel 15 foldably connected to a first side panel 17 at a first lateral fold line 19, a second side panel 23 foldably connected to the bottom panel 15 at a second lateral fold line 25, and a top panel 29 foldably connected to the second side panel 23 at a third lateral fold line 31. In one embodiment, an adhesive flap 33 is foldably connected to the top panel 29 at a fourth lateral fold line 37.

The bottom panel 15 is foldably connected to a first bottom end flap 43 and a second bottom end flap 45. The first side panel 17 is foldably connected to a first side end flap 47 and a second side end flap 49. The second side panel 23 is foldably connected to a third side end flap 53 and a fourth side end flap 55. The top panel 29 is foldably connected to a first top end flap 57 and a second top end flap 59. When the carton 5 is erected, the end flaps 43, 47, 53, 57 close a first end 72 of the carton, and the end flaps 45, 49, 55, 59, close a second end 74 of the carton. In accordance with an alternative embodiment of the present disclosure, different flap arrangements can be used for closing the ends of the carton 5.

The end flaps 43, 47, 53, 57 extend along a first marginal area of the blank 3, and are foldably connected at a first longitudinal fold line 67 that extends along the length of the blank. The end flaps 45, 49, 55, 59 extend along a second marginal area of the blank 3, and are foldably connected at a second longitudinal fold line 69 that also extends along the length of the blank. The longitudinal fold lines 67, 69 may be, for example, substantially straight, or offset at one or more locations to account for blank thickness or for other factors without departing from the scope of the disclosure.

As shown in FIG. 1, the blank 3 has handle features for forming a handle 11 at each end 72, 74 of the carton 5. The handle features include handle flaps 95 foldably connected to a respective top end flap 57, 59, and notches or openings 97 in the side end flaps 53, 55, 47, 49. The openings 97 cooperate to provide an opening at a respective closed end 72, 74 to allow a respective handle flap 95 to be inwardly folded so that the carton 5 can be grasped at a respective end. The blank 3 can have other features for forming the handle 11, or the blank and/or carton can have a handle that is alternatively shaped, arranged, and/or configured without departing from the disclosure. Further, the handle 11 can be omitted without departing from the disclosure.

In one embodiment, the blank 3 has features for forming article protection features in the ends 72, 74 of the carton 5. As shown in FIG. 1, the side end flaps 47, 49, 53, 55 have deformations in the form of indentations 105 on the exterior surface 1 of the blank 3 such that the indentations form a protrusion on the interior surface of the blank. The bottom end flaps 43, 45 each have two rows of deformations in the form of indentations 107 on the interior surface of the blank 3 such that the indentations on the interior surface form a protrusion on the exterior surface 1 of the blank 3. As shown in FIG. 1, the top end flaps 57, 59 each have a respective distal edge 111 having corner notches 113 and a center notch 115. The indentations 105, 107 can be any deformation on a surface of a respective side end flaps 47, 49, 53, 55 or bottom end flap 43, 45 such that the deformation can be any suitable shape (e.g., a concave depression or protrusion, convex depression or protrusion, flat depression or protrusion, embossed area, debossed area, etc., or any other suitable shape). Furthermore, the indentations 105, 107 could be formed on the interior or exterior surface of one or more of the first side panel 17, second side panel 23, top panel 29, bottom panel 15, or top end flaps 57, 59 without departing from the disclosure. The blank 3 can have other protection features that are alternatively shaped, arranged, and/or configured without departing from the disclosure. Further, the indentations 105, 107 can be omitted without departing from the disclosure.

In the illustrated embodiment, the blank 3 includes three bottom article protection flaps 121 arranged in a 1×3 arrangement and foldably connected to the bottom panel 15, but the blank 3 could have more or less than three bottom article protection flaps 121, and the flaps 121 could be otherwise arranged in other suitable row/column arrangements or in a random configuration on the bottom panel 15, including a multiple row or a multiple column configuration, or any other suitable configuration. The bottom article protection flaps 121 are each foldably connected to the bottom panel 15 at a respective lateral fold line 123 and are each at least partially defined by a line of weakening 125 in the bottom panel 15. In one embodiment, the line of weakening 125 is a cut, but the line of weakening could comprise other forms of weakening (e.g., a tear line that comprises cut lines separated by breakable nicks, a tear line that is formed by a series of spaced apart cuts, etc.) that allow the bottom article protection flap 121 to separate from the bottom panel 15 without departing from the disclosure. In other embodiments, the blank 3 can include bottom article protection flaps 121 that are otherwise, shaped, arranged, and/or configured without departing from the disclosure. The bottom article protection flaps 121 could be omitted without departing from the disclosure.

Figure 3:
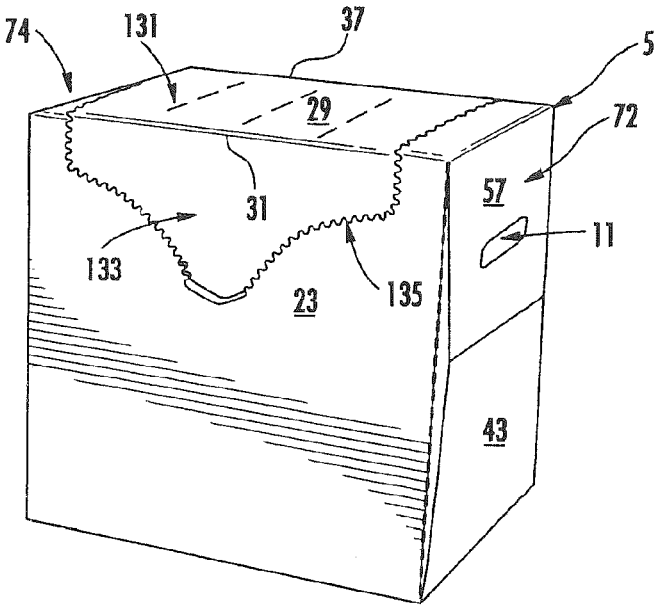
FIG. 3 is a perspective view of an assembled carton according to the first exemplary embodiment of the disclosure.
Figure 7:
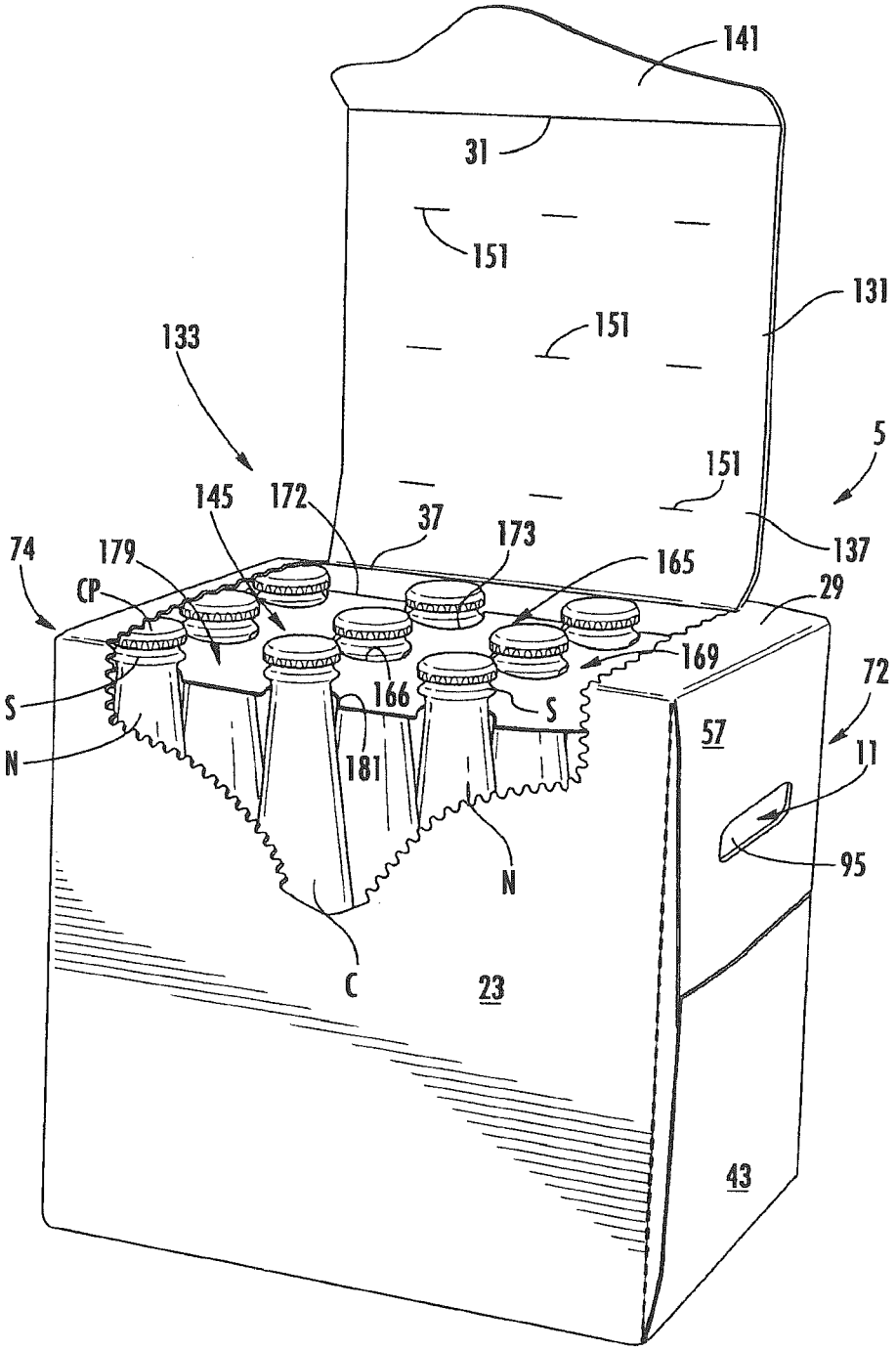
FIG. 7 is a perspective view similar to FIG. 3 with a dispenser in an open position.
Figure 8:
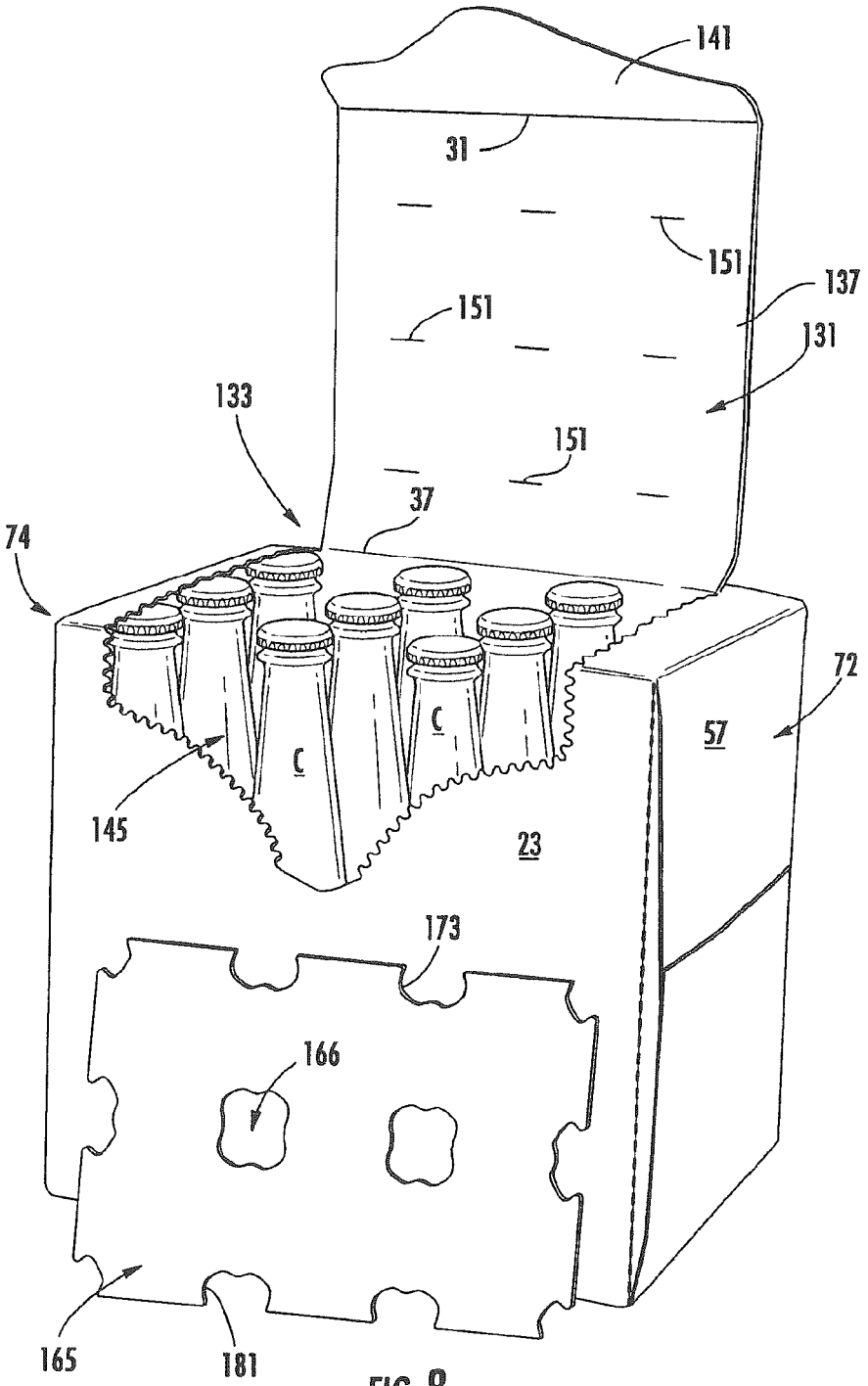
FIG. 8 is a perspective view similar to FIG. 7 showing an article protection insert removed to allow access to articles in the carton.

In one embodiment, the blank 3 comprise a dispenser panel 131 in the top panel 29 and the second side panel 23 for forming a dispenser 133 in the carton 5. The dispenser panel 131 is formed by a dispenser pattern or tear line 135 that extends from the lateral fold line 37, across the top panel 29, and into a portion of the second side panel 23. In one embodiment, the dispenser panel 131 comprises a first portion 137 in the top panel 29 and a second portion 141 foldably connected to the first portion at a portion of the lateral fold line 31 extending across the dispenser panel 131. As shown in FIGS. 3, 7, and 8, the second portion 141 of the dispenser panel 131 forms an access flap for grasping and initiating separation of the dispenser panel from the carton 5 to create the dispenser opening 145 for accessing the containers C. The dispenser panel 131 could be otherwise shaped, arranged, and/or configured without departing from the disclosure. Further, the dispenser 133 and the dispenser panel 131 could be omitted without departing from the disclosure.

Figure 6:
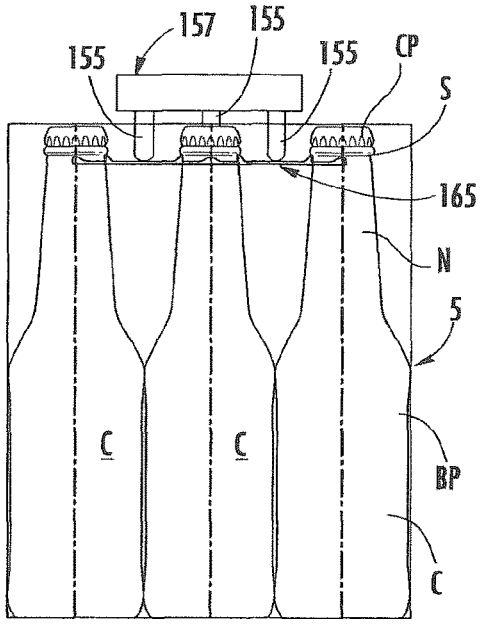
FIG. 6 is a side schematic view of the carton with a carton forming machine positioning an article protection insert to a second position.

As shown in FIG. 1, the top panel 29 includes nine access features 151 in the form of cuts arranged in a 3×3 arrangement with three cuts in each row and column. The access features 151 could be openings in the top panel 29 or the access features could comprises flaps foldably connected to the top panel to create an access opening when folded relative to the top panel. Further, there could be more or less than nine access features 151 in the top panel or the access features could be otherwise shaped, arranged, and/or configured without departing from the disclosure. The access features 151 are for receiving a respective actuator or finger 155 of a carton forming machine 157 (FIGS. 5 and 6). In one embodiment, the access features 151 are provided in the dispenser panel 131. The access features 151 could be otherwise shaped, arranged, positioned, and/or configured without departing from the disclosure.

Figure 2:
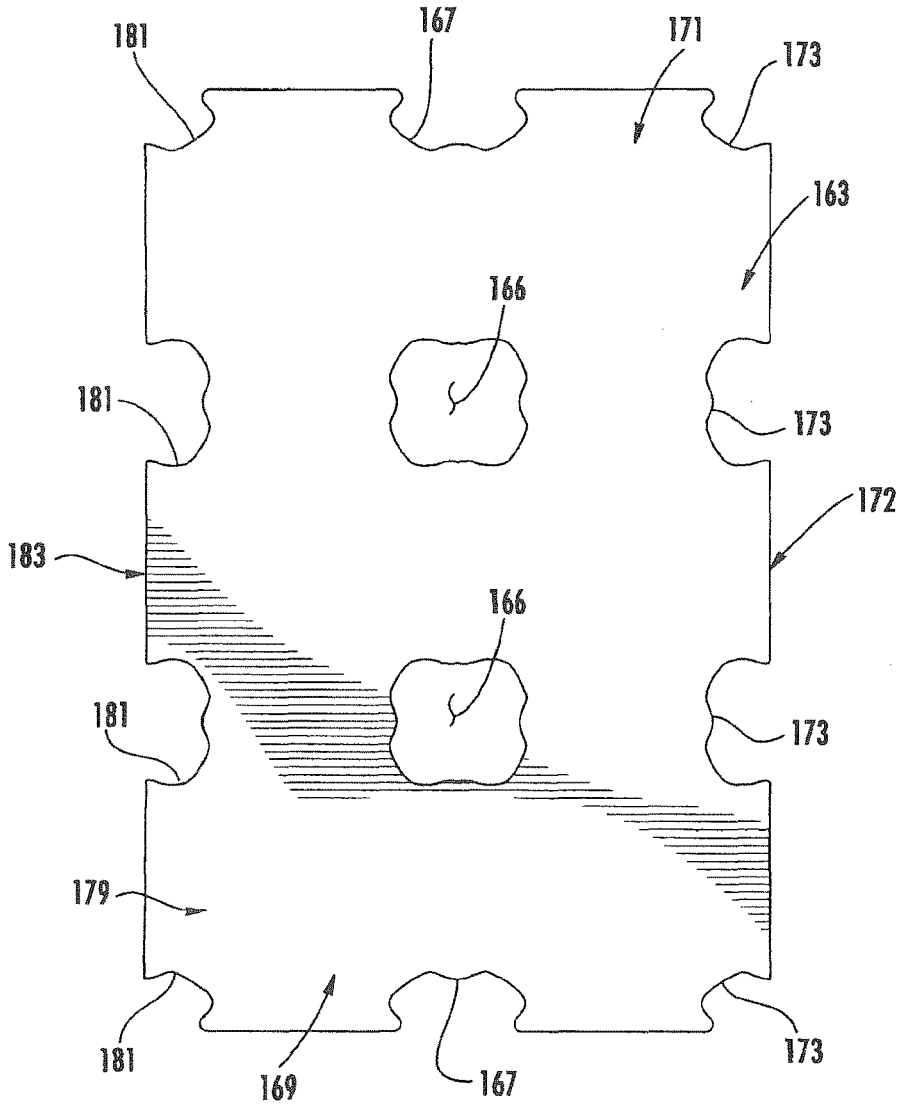
FIG. 2 is a plan view of an exterior surface of an article protection insert blank according to the first exemplary embodiment of the disclosure.

As shown in FIG. 2, an article protection insert blank 163 is shown for forming an article protection insert 165 (FIG. 7) in the carton 5. In one embodiment, the article protection insert blank 163 can include features for engaging the articles C that include two central openings 166 and two notches 167 in a middle portion 169 of the article protection insert blank. The article protection insert blank 163 includes a first outer portion 171 that has four notches 173 at a distal edge 172 of the article protection insert blank. The article protection insert blank 163 includes a second outer portion 179 that is shaped similar to the first outer portion 171 and has four notches 181 at a distal edge 183 of the article protection insert blank. As shown in FIGS. 5 and 7, the features of the article protection insert 165 for engaging the articles C can include the openings 166 and notches 167, 173, 181. In the embodiment of FIGS. 6 and 7, the article protection insert 165 is positioned so that the features 166, 167, 173, 181 engage a respective container below the shoulder S of each container C such that the insert engages an underside of the shoulder to restrain the movement of the containers C in the carton 5. In the embodiment of FIG. 5, the article protection insert 165 is positioned so that the features 166, 167, 173, 181 engage a respective container C below the cap CP of each container such that the insert engages an underside of the cap CP to restrain the movement of the containers C in the carton. The article protection insert 165 could be otherwise shaped, arranged, configured, and/or positioned such as to engage other portions of the containers C (e.g., the neck N) without departing from the disclosure. The features 166, 167, 173, 181 of the article protection insert 165 could comprise retention flaps or other features for engaging the containers C. The article protection insert 165 and the article protection insert blank 163 could be otherwise shaped, arranged, and/or configured or could have other features without departing from the disclosure.

In accordance with one exemplary embodiment, the carton can be formed from the carton blank 3 and the article protection insert blank 163 by attaching the article protection insert blank to the top panel 29 by glue or other adhesive. The attachment of the article protection insert blank 163 to the carton blank 3 is a temporary attachment as the article protection insert blank can be secured to the top panel 29 by releasable adhesive such as glue or other suitable adhesive. Further, at various stages of the erecting process, glue or other adhesive can be applied to various portions of the blank 3. After attaching the article protection insert blank 163 to the top panel 29, the combined blanks 3, 163 can be formed into an open-ended sleeve by folding the bottom panel 15, side panels 17, 23, and top panel 29 along respective fold lines 19, 25, 31, 37. Containers C can be loaded into an interior space of the sleeve. One of the ends 72, 74 can be closed prior to loading the containers C or both of the ends can be closed after loading the containers into the interior space.

After closing the ends 72, 74 (or alternatively, prior to closing the ends), the article protection insert 165 can be positioned to engage the articles C. As shown in FIGS. 5 and 6, a carton forming machine 157 having fingers or actuators 155 can be used to separate the article protection insert 165 from the top panel 29 and position the article protection insert 165 on the articles C. The actuators 155 of the carton forming machine 157 are inserted through the access features 151 in the top panel 29 to contact the article protection insert 165. In one embodiment, the carton forming machine 157 has a total of nine actuators 155 arranged in a 3×3 configuration with a respective row of three actuators respectively contacting the middle portion 169, the first outer portion 171, and the second outer portion 179. The carton forming machine 157 could have more or less than nine actuators 155 or the actuators could be otherwise shaped, arranged, and/or configured without departing from the disclosure. In the illustrated embodiment, the actuators 155 press down on the article protection insert 165 by way of the access features or cuts 151 in the top panel 29. When the article protection insert 165 is contacted by the actuators, the article protection insert breaks the adhesive bond with the top panel 29 and separates from the top panel such that the carton forming machine 157 positions the article protection insert to be generally parallel and spaced apart from the top panel 29. In the embodiment of FIG. 5, the article protection insert 165 is positioned so that the features 166, 167, 173, 181 of the article protection insert engage the underside of a cap CP of a respective container C. In the embodiment of FIG. 6, the article protection insert 165 is positioned so that the features 166, 167, 173, 181 of the article protection insert engage the shoulder S or the underside of the shoulder. Alternatively, one or more of the notches 173, 181 could engage an underside of the shoulder S of a respective container C in the carton 5 and the openings 166 and/or notches 167 could engage the underside of the cap CP of a respective container in the carton. Further, one or more of the notches 173, 181 could engage an underside of a cap CP of a respective container C in the carton 5 with one or more of the openings 166 and/or notches 167 engaging an underside of the shoulder S of a respective container in the carton 5. Also, the article protection insert 165 could be positioned so that one or more of the features 166, 167, 173, 181 engages the neck N of the respective containers in the carton 5. The article protection insert 165 is positioned to engage a top portion of the containers C in the carton 5 to prevent or reduce the movement of the containers in the carton and to prevent or reduce breakage of the containers articles. The article protection insert 165 could be otherwise positioned in the carton 5 without departing from the disclosure.

Figure 4:
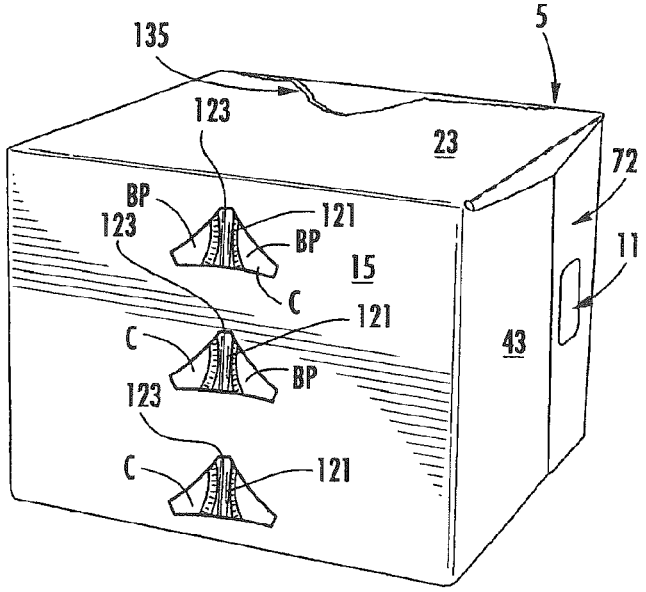
FIG. 4 is a bottom perspective view of the assembled carton of FIG. 3.

In one embodiment, the loaded and closed carton 5 is further processed so that the bottom article protection flaps 121 are activated to provide a cushion between the bottom portions BP of the containers C inside the carton and further secure the containers to prevent breaking. The bottom article protection flaps 121 are foldably connected to the bottom panel 15 and moveable between a first position (that is substantially parallel to the bottom panel) and a second position (FIG. 4) wherein the bottom article protection flaps are folded upwardly relative to the bottom panel 15. In one embodiment, the bottom article protection flaps 121 are raised or activated and the bottom article protection flaps have features for preventing the folding of the article protection flaps from the second position back to the first position. It is understood that the bottom article protection flaps 121 will be activated to the second position (FIG. 5) after the ends 72, 74 of the carton 5 have been closed. Alternatively, the bottom article protection flaps 121 could be activated prior to closing one or both of the ends 72, 74 of the carton 5 without departing from the disclosure. In one embodiment, the bottom article protection flaps 121 are in contact with the bottom portion BP of the containers C, and the article protection insert 165 is in contact with the top portion of the containers (e.g., neck N, cap CP, or shoulder S) to prevent or reduce the movement of the containers C in the carton 5 and to prevent or reduce breakage of the containers or other articles. The carton 5 and article protection insert 165 could be formed by other different steps, processes, or features without departing from the disclosure.

Figure 9:
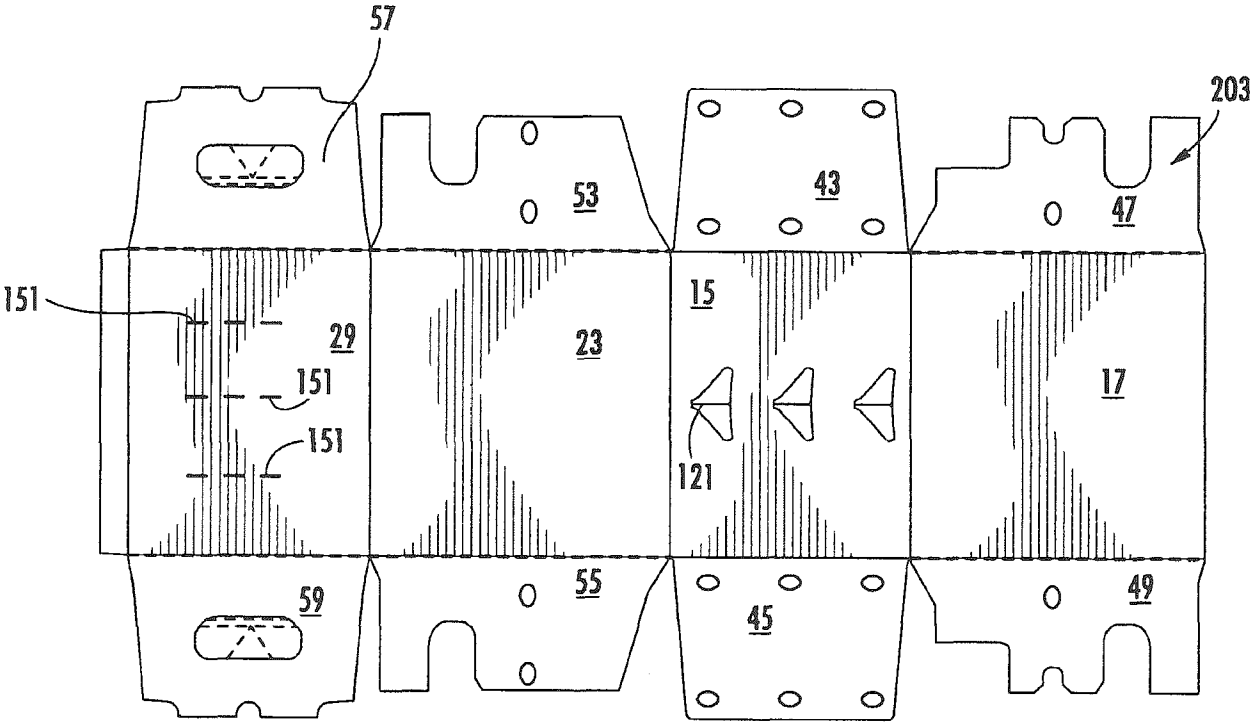
FIG. 9 is a plan view of an exterior surface of a carton blank according to a second exemplary embodiment of the disclosure.
Figure 10:
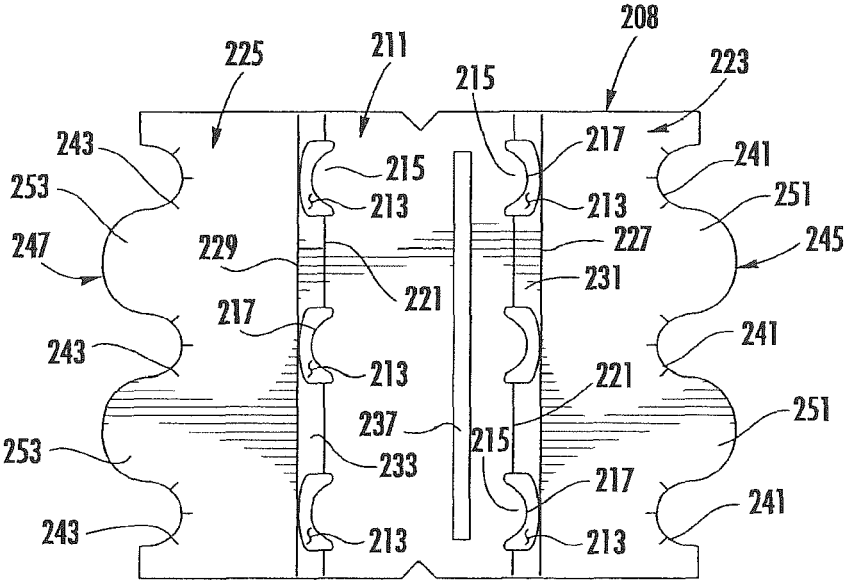
FIG. 10 is a plan view of an exterior surface of an article protection insert blank according to the second exemplary embodiment of the disclosure.

FIGS. 9-12 illustrate various features of a carton blank 203 and an article protection insert blank 208 for forming a carton 205 having an article protection insert 210 of a second embodiment, the second embodiment having similar features as the first embodiment of the disclosure. Accordingly, similar or identical features of the embodiments are provided with like or similar reference numbers. As shown in FIG. 9, the carton blank 203 is similar to the carton blank 3 of FIG. 1, except the carton blank 203 does not have a dispenser panel 131 forming the dispenser 133 of the first embodiment. As shown in FIG. 10, the article protection insert blank 208 comprises a middle portion 211 having arcuate openings 213 with tabs 215 having a curved edge 217 adjacent each opening 213. In one embodiment, the middle portion 211 comprises fold lines 221 extending between adjacent arcuate openings 213 across the width of the article protection insert blank 208. The article protection insert blank 208 comprises a first outer portion 223 and a second outer portion 225 that are respectively foldably connected to the middle portion 211 at respective fold lines 227, 229 that are adjacent respective arcuate openings 213. A first foldable portion 231 of the middle portion 211 is formed between respective fold lines 221 and 227 and a second foldable portion 233 of the middle portion is formed between the respective fold lines 221 and 229. In one embodiment, the article protection insert blank 208 includes a strip 237 of adhesive such as releasable adhesive for temporarily attaching the article protection insert blank to the top panel 29. One or more strips of adhesive 237 could be provided, or the article protection insert blank 208 could be attached to the carton blank 203 by other means.

In one embodiment, each of the first outer portion 223 and the second outer portion 225 has respective notches 241, 243 in a respective outer edge 245, 247 of the article protection insert blank 208. Each of the first outer portion 223 and the second outer portion 225 has a respective projection 251, 253 between respective adjacent notches 241, 243. The article protection insert blank 208 and the article protection insert 210 could be otherwise shaped, arranged, and/or configured without departing from the disclosure.

Figure 11:
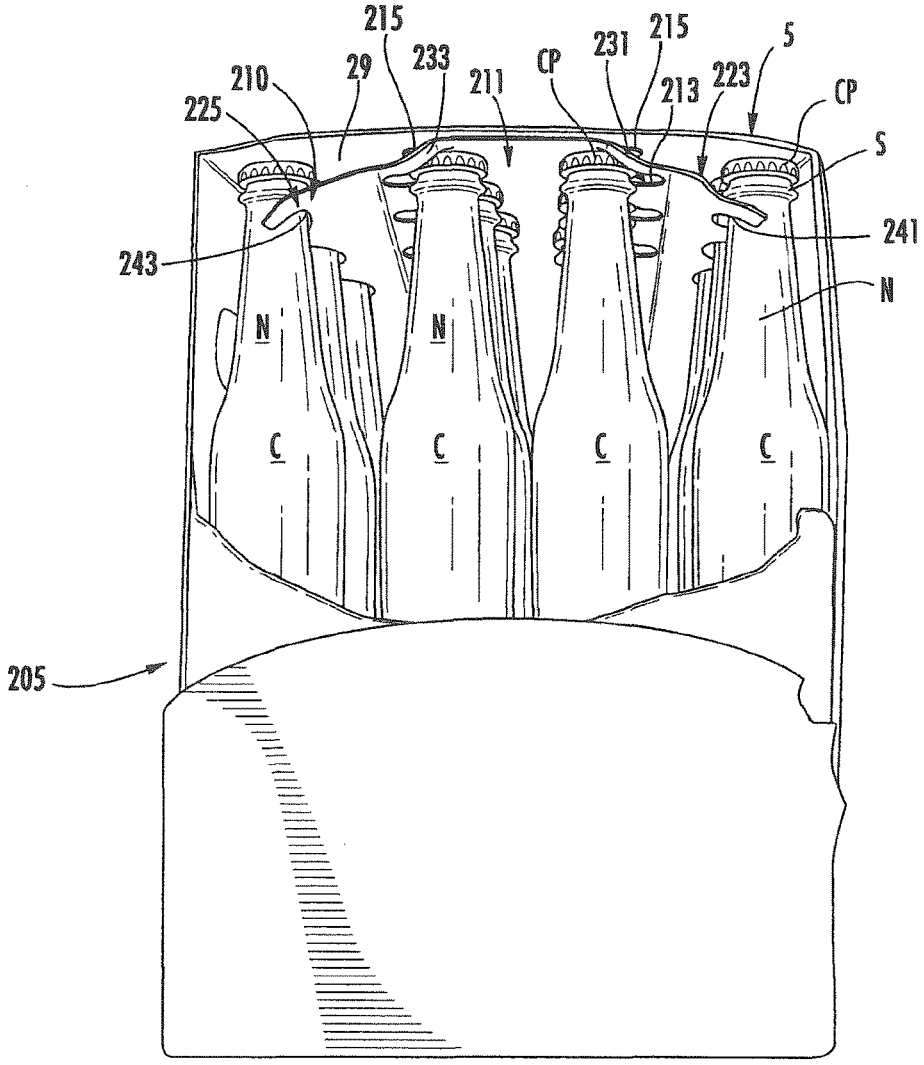
FIG. 11 is side perspective view of the assembled carton of the second embodiment with a portion of the carton removed to show an interior of the carton with the article protection insert in a first position.
Figure 12:
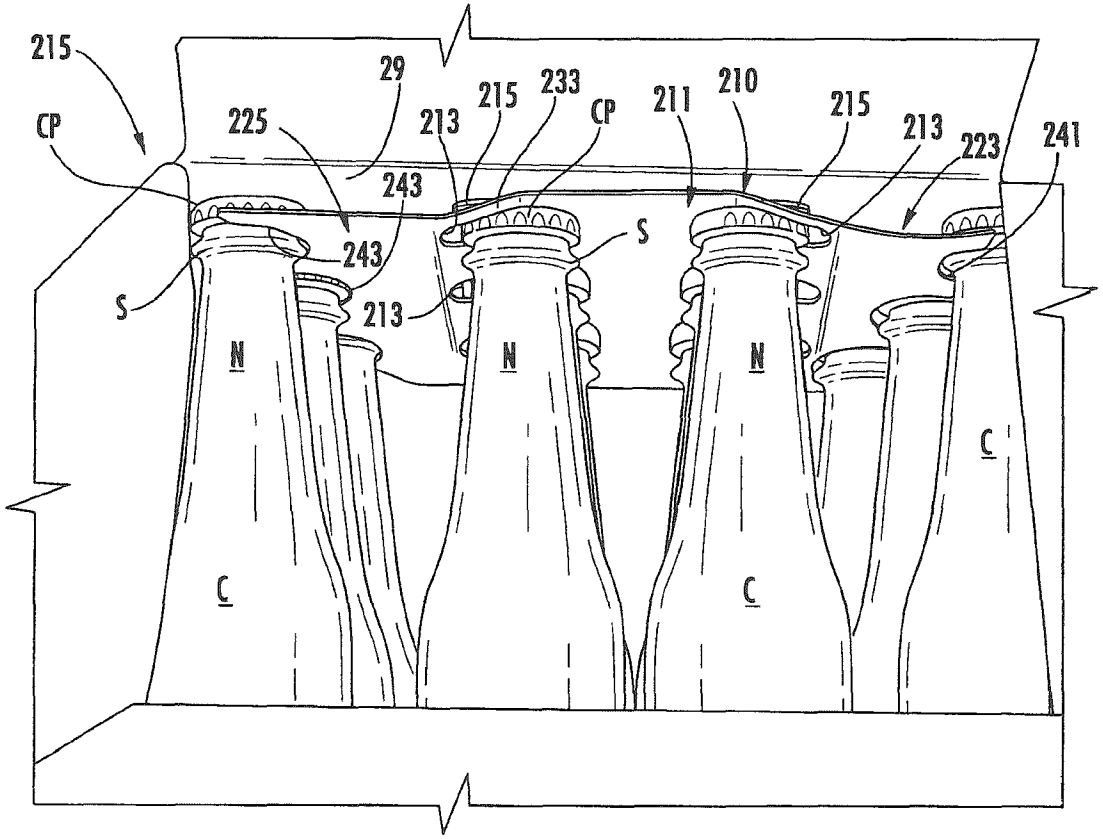
FIG. 12 is side perspective view of a portion of the assembled carton of the second embodiment with a portion of the carton removed to show an interior of the carton with the article protection insert in a second position.

As shown in FIG. 11 the article protection insert blank 208 can be positioned to form the article protection insert 210 by the carton forming machine 157 to retain the articles C in a similar manner as the article protection insert 165 of the first embodiment. In one embodiment, the middle portion 211 of the article protection insert 210 is in face-to-face contact with the interior surface of the top panel 29 with the tabs 215 in contact with a top surface of the caps CP of the containers C in the two middle rows. In the embodiment of FIG. 11, the two outer portions 223, 225 of the article protection insert 210 can be pushed downward to extend downwardly from the middle portion 211 so that the notches 241, 243 engage a respective neck N of the containers C in the two outer rows. The edges of the middle portion 211 adjacent the arcuate openings 213 can engage the shoulders S, the underside of the caps C, or the necks N of the containers C in the two middle rows without departing from the disclosure. As shown in FIGS. 11 and 12, at least a portion of the caps CP of the containers C in the two middle rows extend through the arcuate openings 213 with the foldable portions 231, 233 extending obliquely from the tabs 215 that are in face-to-face contact with the top panel 29 of the carton 5 and the caps CP of the containers C. In the embodiment of FIG. 12, the middle portion 211 of the article protection insert 210 is arranged similar to the positioning shown in FIG. 11. As shown in FIG. 12, the two outer portions 223, 225 of the article protection insert 210 engage the underside of a respective cap CP of the containers C of the two outer rows. The article protection insert 210 could be otherwise shaped, arranged, and/or configured without departing from the disclosure.

Figure 13:
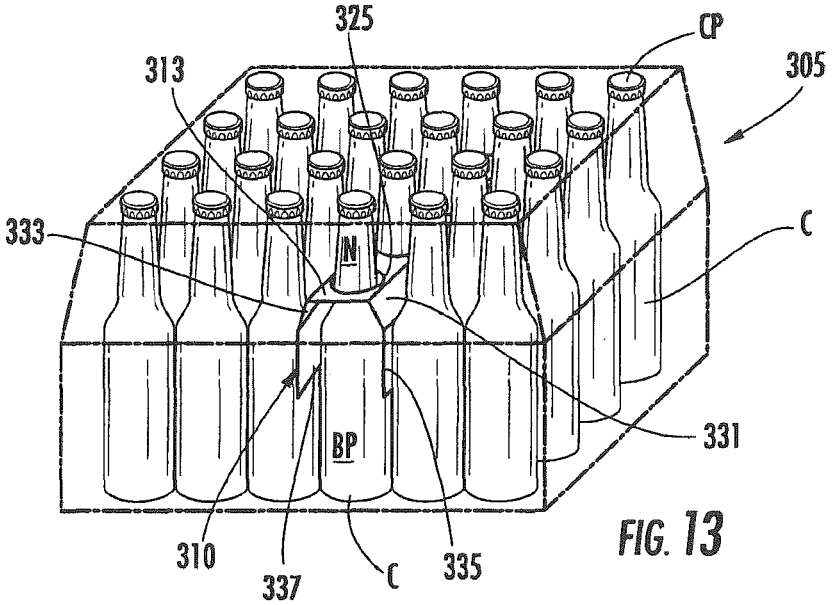
FIG. 13 is a schematic view of a carton with an article protection insert of a third exemplary embodiment of the disclosure.
Figure 14:
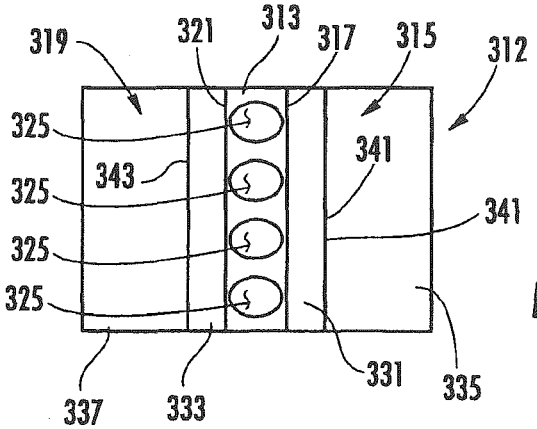
FIG. 14 is a plan view of an exterior surface of an article protection insert blank of the third exemplary embodiment.

FIGS. 13 and 14 show an alternative embodiment of a carton 305 having an article protection insert 310 formed from an article protection insert blank 312. The outline of the carton 305 is shown in FIG. 13 to give an approximation of some of the features of one embodiment of a carton, but the article protection insert 310 could be used with any other suitable carton design without departing from the disclosure. In the embodiment of FIGS. 13 and 14, the article protection insert 310 has a top panel 313, a first side panel 315 foldably connected to the top panel at a fold line 317, and a second side panel 319 foldably connected to the top panel at a fold line 321. In one embodiment, the top panel 313 has openings 325 for receiving a neck N of a respective container C in the carton 305. In one embodiment, each of the side panels 315, 319 has a respective upper portion 331, 333 foldably connected to a respective lower portion 335, 337 at a respective fold line 341, 343.

As shown in FIG. 13, the article protection insert 310 is formed so that the necks N of the containers C of a row of containers are received in respective opening 325 in the top panel 313. The first side panel 315 is folded with respect to the top panel 313 and extends downwardly from the top panel 313 and is between an adjacent row of containers C loaded in the carton 305. Similarly, the second side panel 319 is folded with respect to the top panel 313 and extends downwardly from the top panel 313 and is between an adjacent row or containers C loaded in the carton 305.

Figure 15:
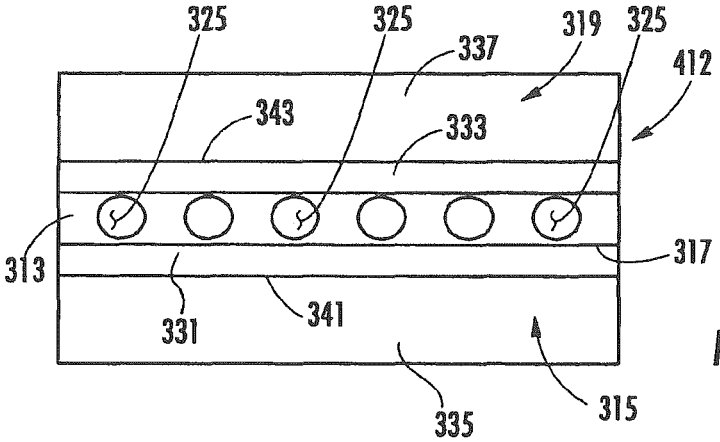
FIG. 15 is a plan view of an exterior surface of an article protection insert blank of an alternative embodiment.

FIG. 15 shows an alternative article protection insert blank 412 similar to the article protection insert blank 312 of the previous embodiment. The article protection insert blank 412 is longer and includes six openings 325 in the top panel to accommodate a row of six containers.

Figure 16:
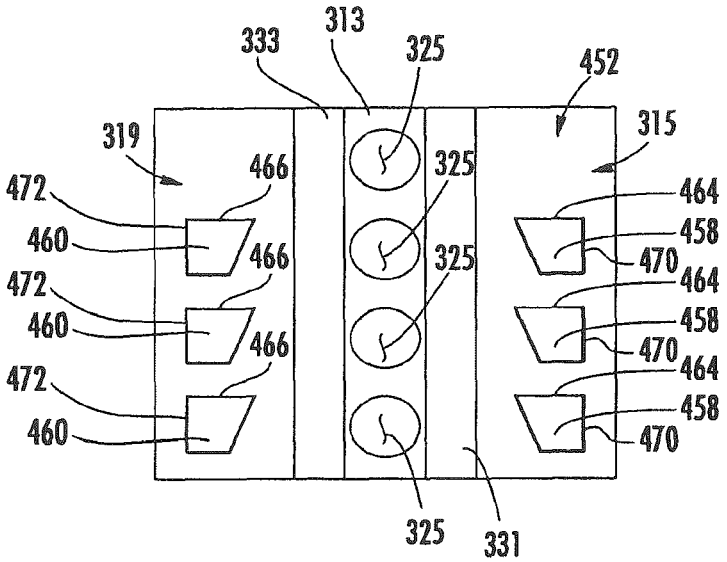
FIG. 16 is a plan view of an exterior surface of an article protection insert blank of an alternative embodiment.
Figure 17:
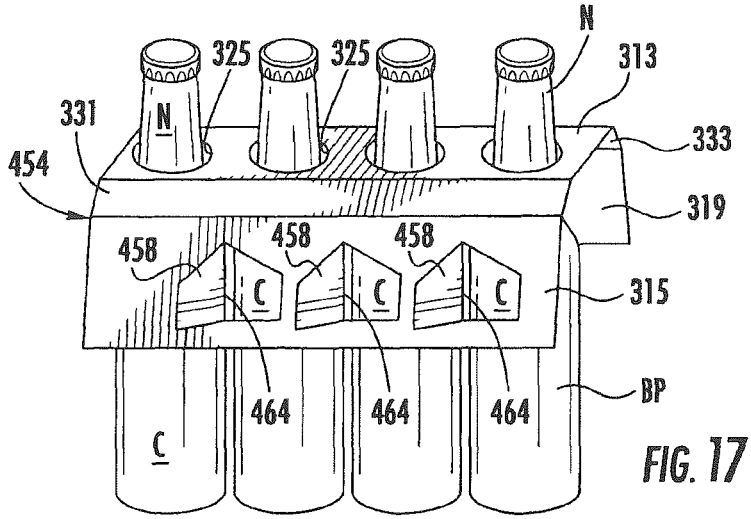
FIG. 17 is a detailed perspective view of an article protection insert formed form the article protection insert blank of FIG. 16 attached to a row of articles.
Figure 18:
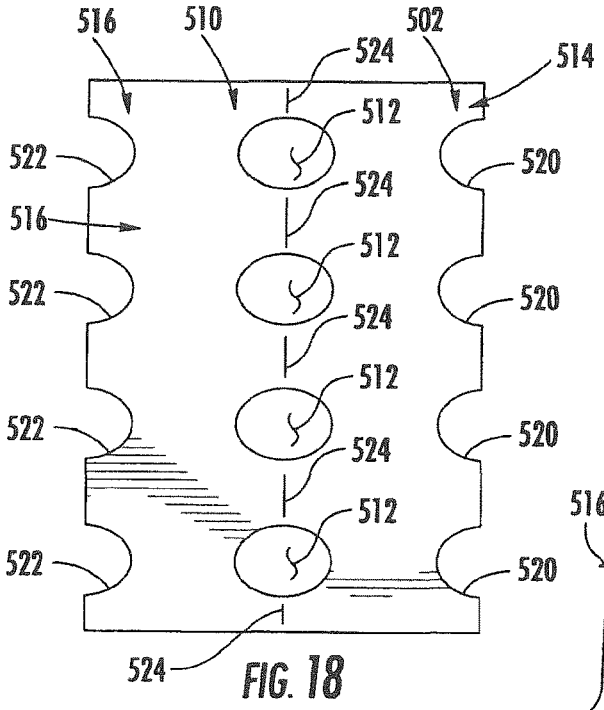
FIG. 18 is a plan view of an exterior surface of an article protection insert blank of an alternative embodiment.
Figure 19:
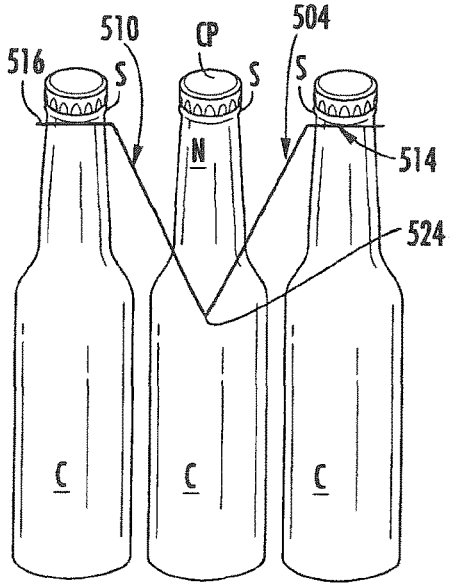
FIG. 19 is a schematic cross-section showing an article protection insert formed from the article protection insert blank of FIG. 18 attached to a group of articles.
Figure 20:
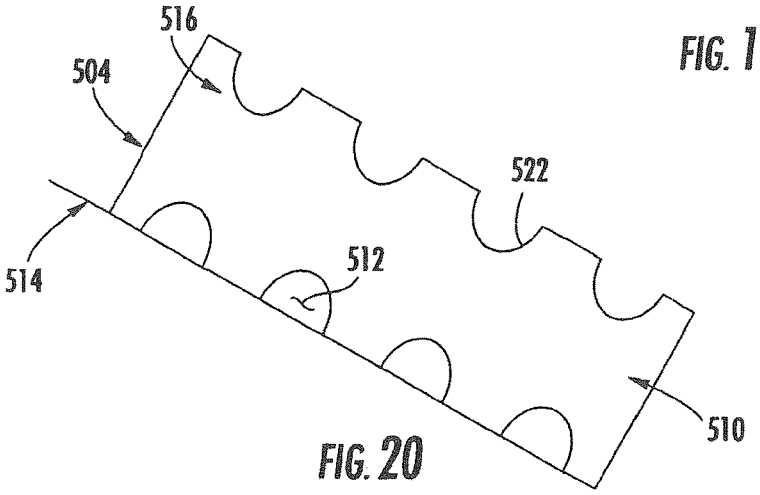
FIG. 20 is a perspective view of the article protection insert of FIG. 19 removed from the group of articles.

FIGS. 16 and 17 show an alternative article protection insert blank 452 for forming an article protection insert 454 similar to the article protection insert blank 312 and article protection insert 310 of the embodiment of FIGS. 13 and 14. The article protection insert blank 452 includes article protection flaps 458 foldably connected to the first side panel 315 and article protection flaps 460 foldably connected to the second side panel 319. The article protection flaps 458, 460 are respectively foldably connected to one of the first side panel 315 and the second side panel 319 at a respective fold line 464, 466. In one embodiment, the article protection flaps 458, 460 are at least partially defined by a respective cut 470, 472 extending from a respective fold line 464, 466. As shown in FIG. 17, the article protection flaps 458, 460 are moveable between a first position substantially parallel to a respective first side panel 315 and a respective second side panel 319 and a second position wherein the article protection flaps are outwardly folded relative to the side panels and positioned for placement between containers of an adjacent row of containers.

Figure 21:
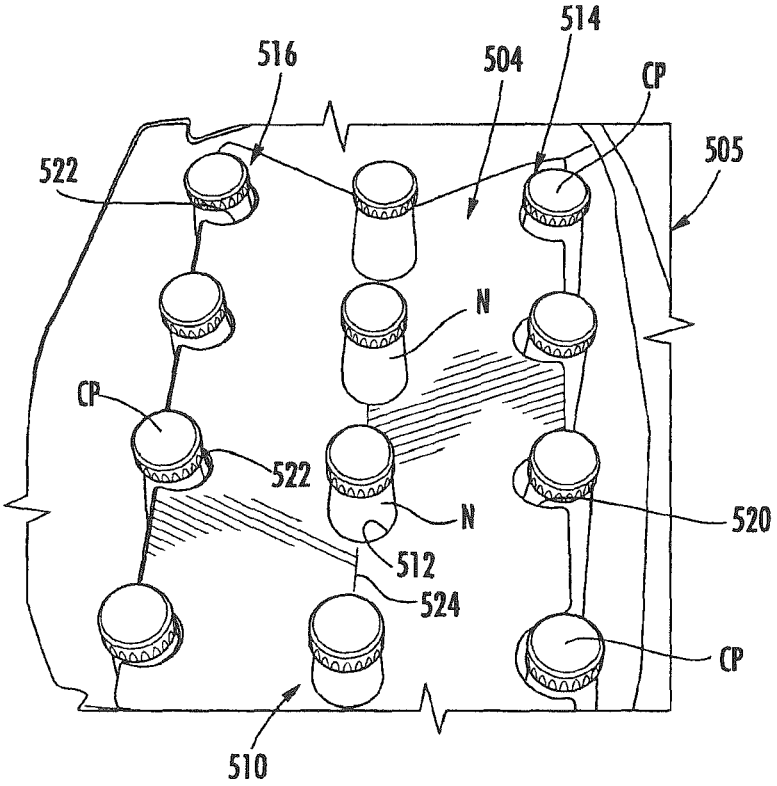
FIG. 21 is a top perspective view of a portion of a carton having the article protection insert of FIG. 19 attached to a group of articles.

FIGS. 18-21 show an alternative article protection insert blank 502 for forming an article protection insert 504 in a carton 505 having similar features as the article protection insert blank 163 and article protection insert 165 of the first embodiment. In the embodiment of FIGS. 18-21, the article protection insert 504 has a middle portion 510 having openings 512 and two outer portions 514, 516 having respective notches 520, 522. In one embodiment, the middle portion 510 comprises fold lines 524 between or adjacent respective openings 512. As shown in FIG. 21, the openings 512 in the middle portion 510 receive a respective neck N of a middle row of containers C and contacts a portion of the containers in the middle row below the shoulder S of the containers C to restrain movement of the containers in the carton. The notches 520, 522 in a respective outer portion 514, 516 of the article protection insert 504 can contact an underside of the cap CP of the containers (FIG. 21) in the two outer rows to restrain movement of the containers C in the carton, or the notches 520, 522 can contact the shoulders S of the containers C (FIG. 19) without departing from the disclosure.

Figure 22:
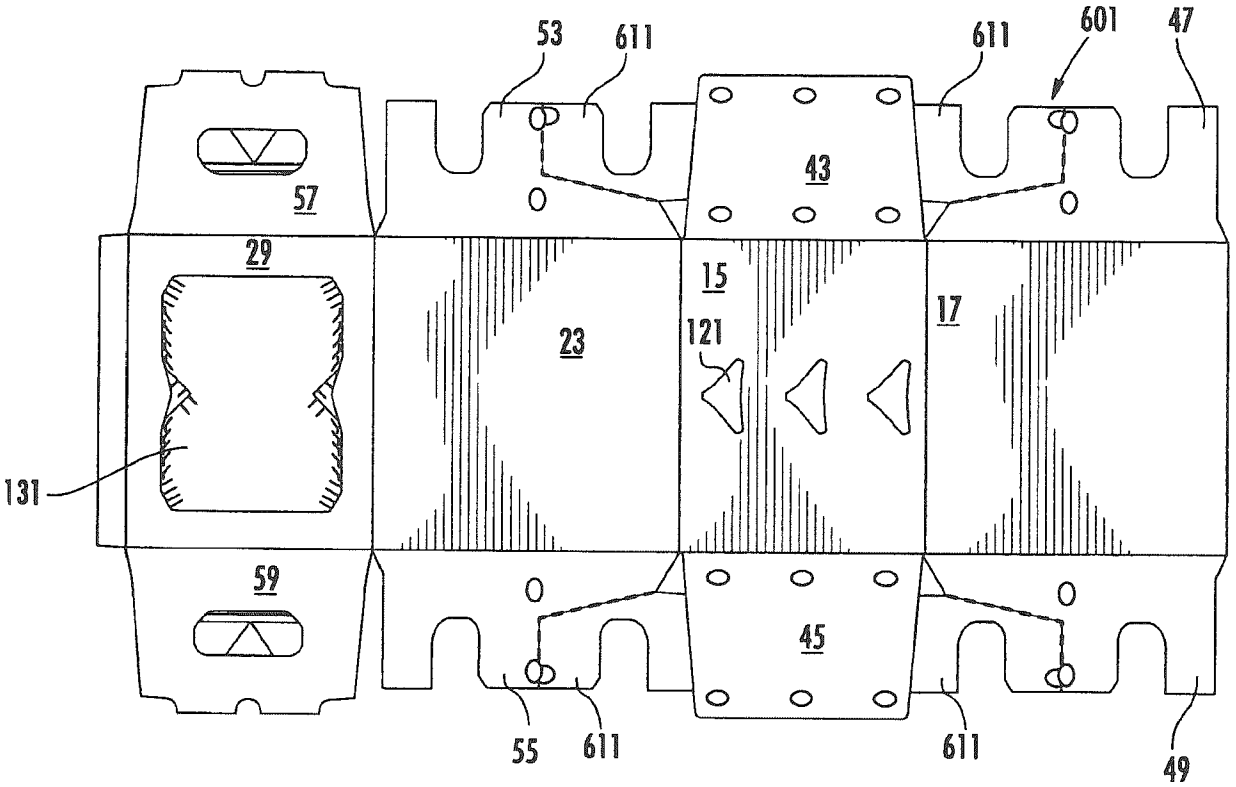
FIG. 22 is a plan view of an exterior surface of a carton blank of a fourth exemplary embodiment of the disclosure.

FIGS. 22-25 show a fourth embodiment of a carton blank 601 and article protection insert blank 603 for forming a carton 605 with an article protection insert 607 similar to the previous embodiments. The carton blank 601 is similar to the carton blank 3 of the first embodiment and like or similar features are indicated with like or similar reference numbers. In the embodiment of FIG. 22, the carton blank 601 includes handle reinforcement flaps 611 foldably connected to a respective side end flap 47, 49, 53, 55 for reinforcing the handle 11 in a respective end 72, 74 of the carton 605. The carton blank 601 could have other features or the features shown could be otherwise shaped, arranged, configured, and/or omitted without departing from the disclosure.

Figure 23:
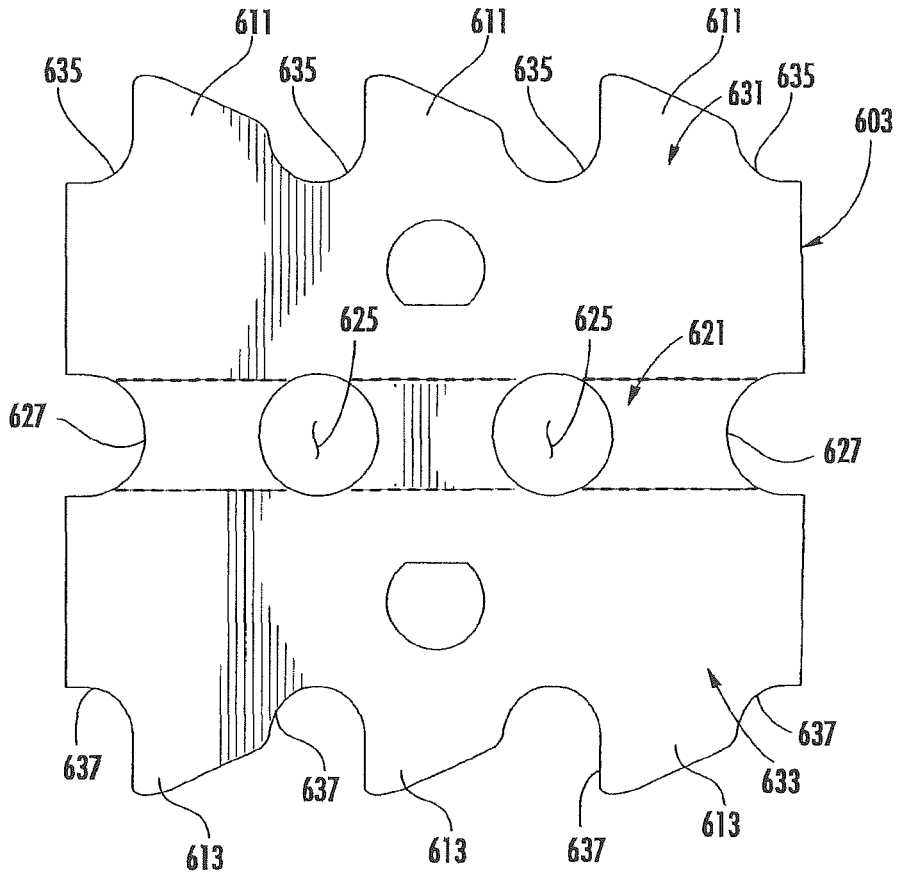
FIG. 23 is a plan view of an exterior surface of an article protection insert blank of the fourth exemplary embodiment of the disclosure.
Figure 24:
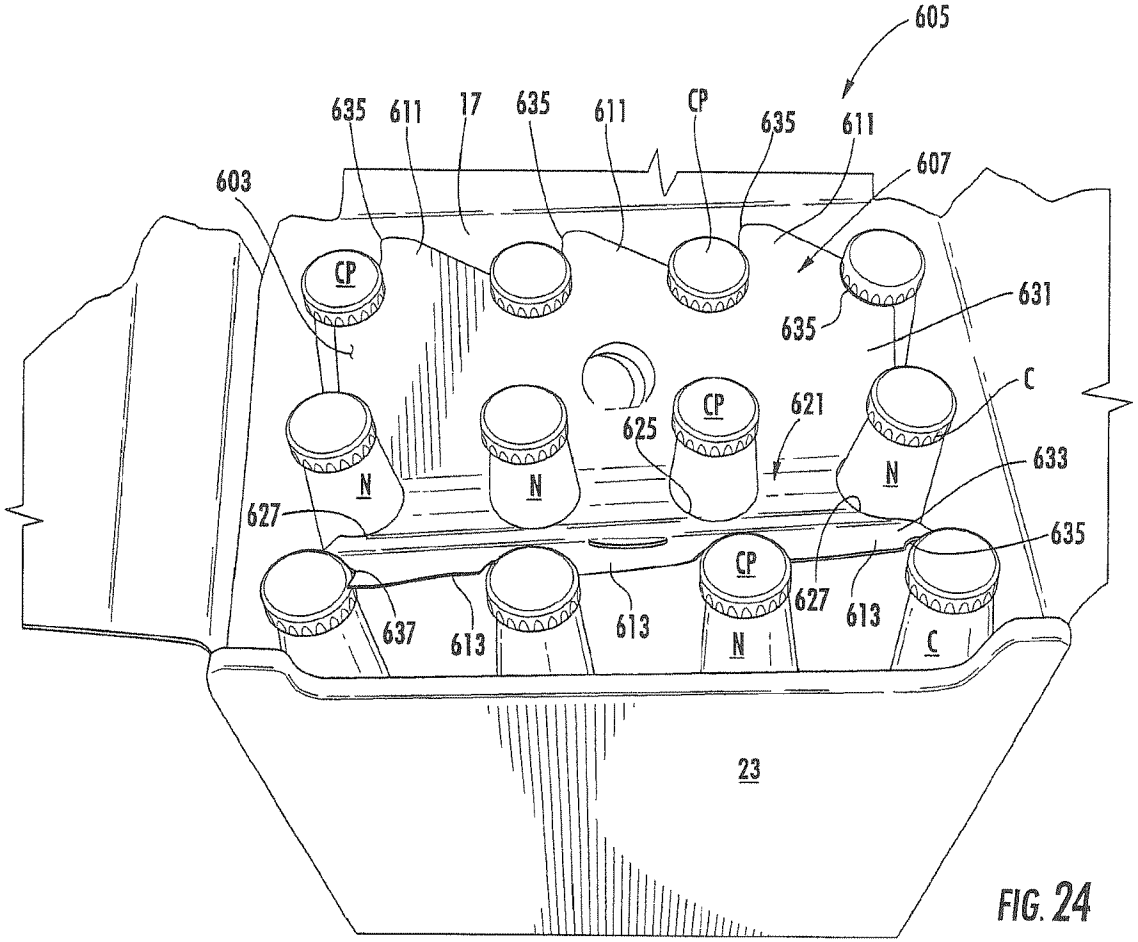
FIGS. 24 and 25 are top perspective views of the carton of the fourth exemplary embodiment of the disclosure with the article protection insert formed from the article protection insert blank of FIG. 23.
Figure 25:
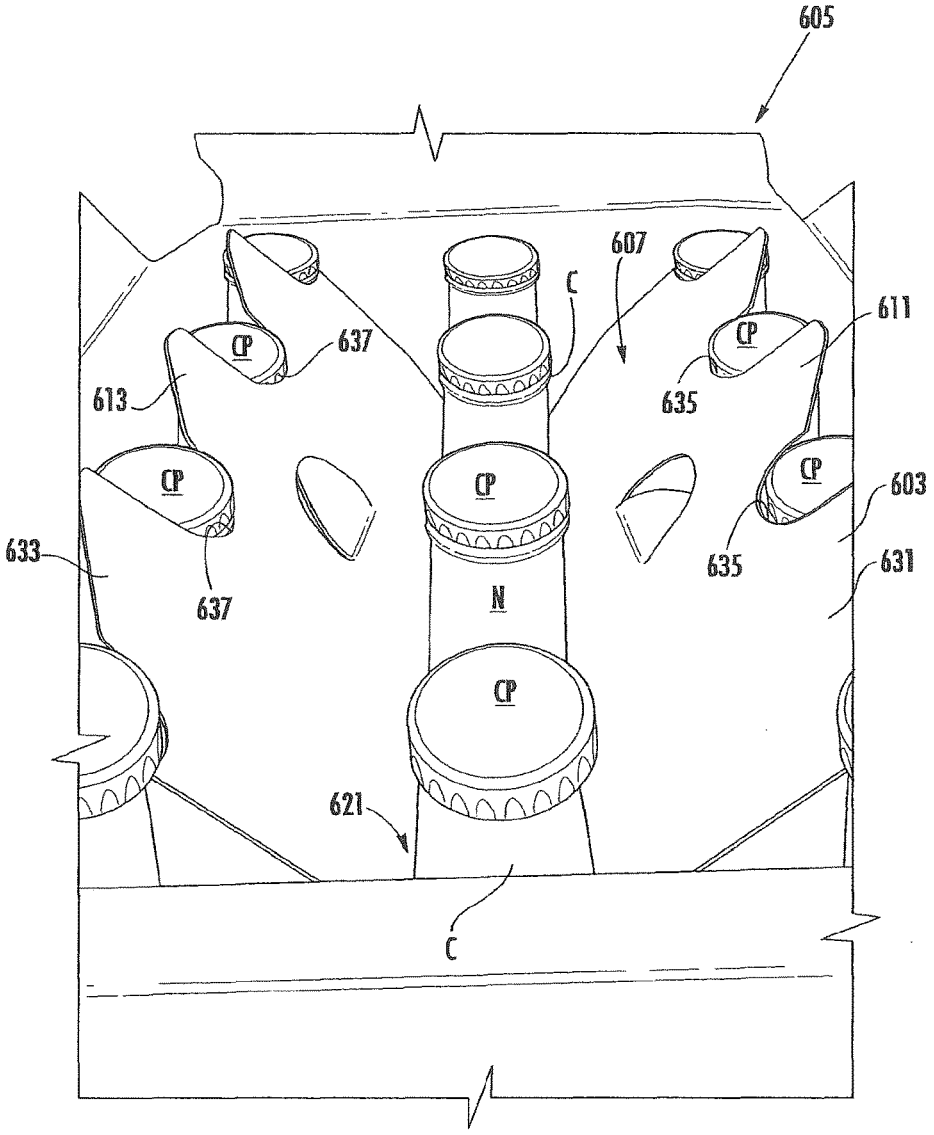
Figure 26:
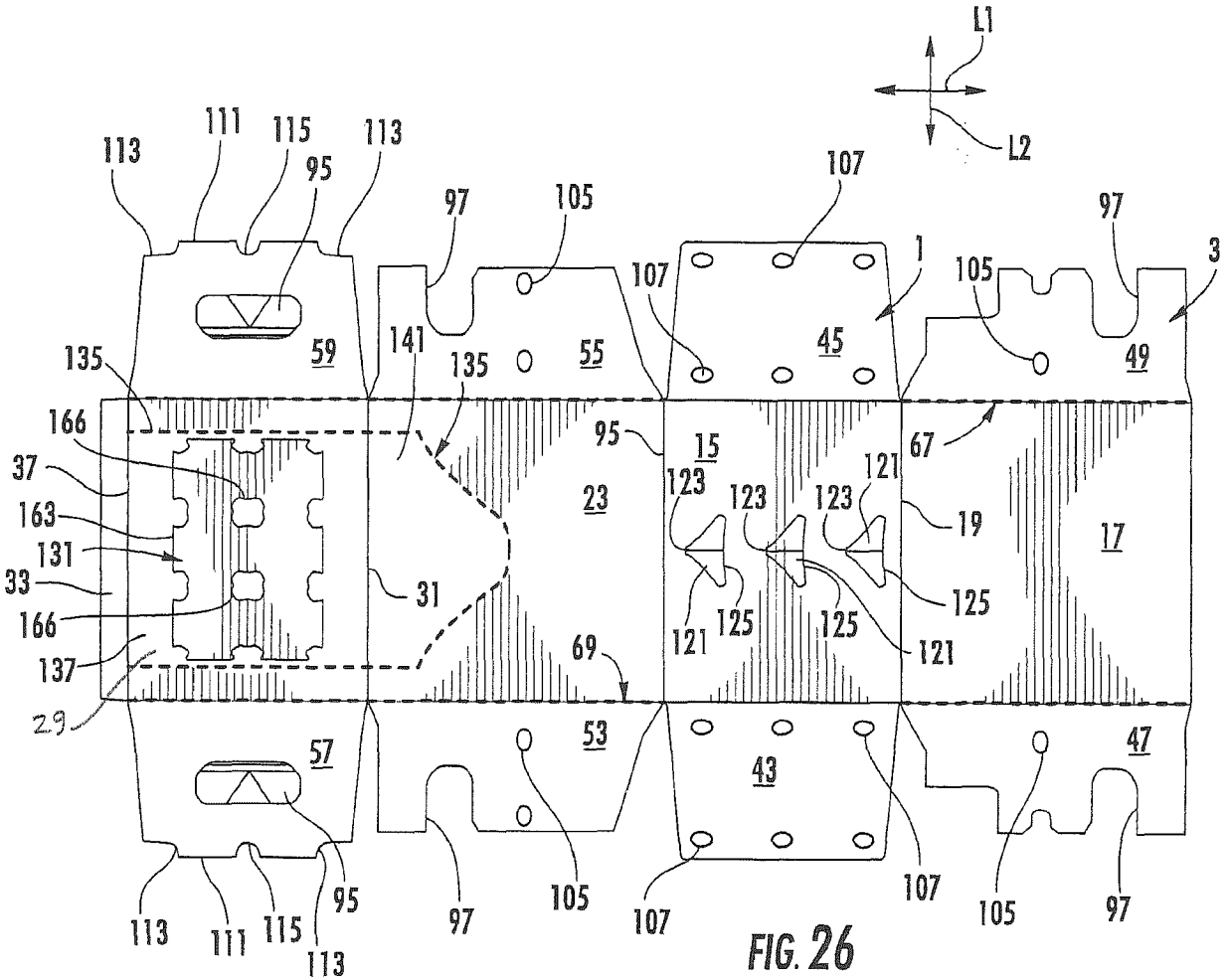
FIG. 26 is a plan view of an interior surface of the carton blank of FIG. 1 with the article protection insert blank of FIG. 2 attached.
Figure 27:
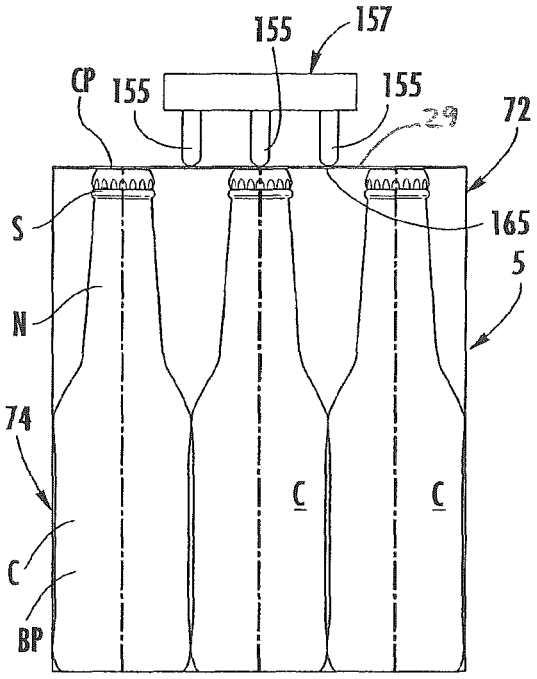
FIG. 27 is a side schematic view of the carton of FIG. 3 with an article protection insert attached to the top panel of the carton
Figure 28:
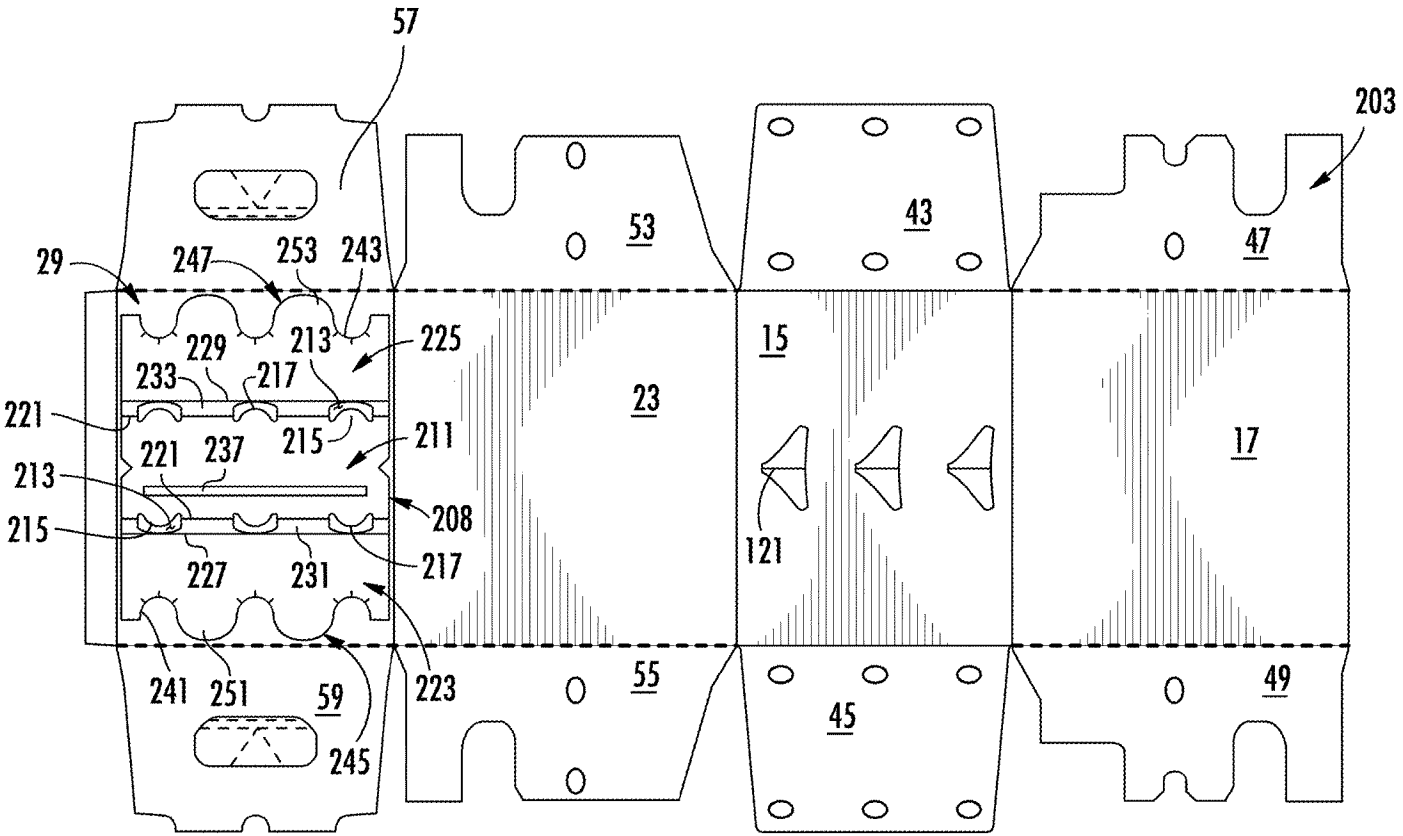
FIG. 28 is a plan view of an interior surface of the carton blank of FIG. 9 with the article protection insert blank of FIG. 10 attached.

FIG. 23 shows the article protection insert blank 603 that has a middle portion 621 having two openings 625 and two notches 627 and two outer portions 631, 633 having respective notches 635, 637. As shown in FIGS. 24 and 25, the openings 625 and notches 627 in the middle portion 621 of the article protection insert 607 receive a respective neck N of the containers in the middle row and the notches 635, 637 of a respective outer portion 631, 633 engage a respective container C in the outer two rows of containers such that the outer portions engage the underside of a cap CP of the containers. The article protection insert 607 has protruding portions 611, 613 between respective adjacent notches 635, 637. The article protection insert 607 could be otherwise shaped, arranged, configured, and could have other features without departing from the disclosure. Further, the article protection insert 607 could be used with a carton blank other than the blank 601 without departing from the disclosure.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blank may then be coated with a varnish to protect information printed on the blanks. The blank may also be coated with, for example, a moisture barrier layer, on either or both sides of the blanks. The blank can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton containing a plurality of articles, the carton comprising:

a plurality of panels that extends at least partially around an interior of the carton, the plurality of panels comprising a top panel, a bottom panel, a first side panel, and a second side panel;

an article protection insert comprising a middle portion, two outer portions, and a plurality of features for engaging a respective article of the plurality of articles, the plurality of features comprising at least one opening extending in at least the middle portion and at least one notch extending along at least one of the two outer portions, the at least one notch being spaced apart from the middle portion, and the at least one opening being adjacent a respective one of the two outer portions; and a plurality of access features in the top panel aligning with the middle portion and two outer portions of the article protection insert, and the article protection insert is positionable from a first position wherein the middle portion is coplanar with the two outer portions to a second position wherein the outer portions are folded relative to the middle portion, the at least one opening engages a respective article of the plurality of articles, and the at least one notch engages a respective article of the plurality of articles, wherein the middle portion is in face-to-face contact with the top panel and the two outer portions extend downwardly from the middle portion in the second position.

2. The carton of claim 1, wherein the at least one notch extends in an outer edge of the article protection insert, the at least one notch being in engagement with at least a portion of an article of the plurality of articles in the second position.

3. The carton of claim 2, wherein the plurality of articles comprises containers having a cap and a shoulder, the plurality of features being in contact with one of the cap and the shoulder in the second position.

4. The carton of claim 3, wherein at least one of the plurality of features engage a respective cap of a respective article of the plurality of articles in the second position.

5. The carton of claim 3, wherein at least one of the plurality of features engage a respective shoulder of a respective article of the plurality of articles in the second position.

6. The carton of claim 3, wherein the middle portion is in contact with respective caps of the containers, the at least one notch comprising notches in a respective outer edge of each of the two outer portions, the notches engaging respective containers at a location below the shoulder in the second position.

7. The carton of claim 6, wherein the at least one opening comprises a plurality of openings and the middle portion has tabs adjacent the openings, the tabs being in contact with a top surface of a cap of the containers and the openings receiving at least a portion of the cap of the containers in the second position.

8. The carton of claim 1, wherein the plurality of access features comprises a plurality of openings in the top panel.

9. The carton of claim 8, wherein the plurality of openings in the top panel comprises a plurality of cuts.

10. The carton of claim 1, further comprising a dispenser, the dispenser comprising a dispenser panel at least partially defined by at least one dispenser pattern extending in at least the top panel, the plurality of access features being in the dispenser panel.

11. The carton of claim 1, wherein the carton further comprising at least one article protection flap foldably connected to the bottom panel, the at least one article protection flap is moveable between a first position that is parallel to the bottom panel and a second position wherein the at least one article protection flap is folded relative to the bottom panel.

12. The carton of claim 11, wherein the article protection flap is for contact with a bottom portion of at least one article of the plurality of articles, and the article protection insert is for contact with a top portion of at least one article of the plurality of articles.

13. The carton of claim 1, wherein the two outer portions of the article protection insert comprise a first outer portion foldably connected to the middle portion along a first fold line and a second outer portion foldably connected to the middle portion along a second fold line.

14. The carton of claim 13, wherein each of the first fold line and the second fold line extends from a first outer edge of the article protection insert to an opposing second outer edge of the article protection insert.

15. The carton of claim 13, wherein the at least one opening comprises at least a first opening and a second opening extending in at least the middle portion, the first opening and the second opening are spaced apart from one another, and the first fold line extends adjacent the first opening and the second fold line extends adjacent the second fold line opening.

16. The carton of claim 15, wherein the at least one opening comprises at least a third opening extending at least in the middle portion, the third opening extends adjacent the first fold line and is spaced apart from the first opening, and a third fold line extends in the middle portion from the first opening to the third opening.

17. The carton of claim 1, wherein:

the two outer portions of the article protection insert comprise a first outer portion foldably connected to the middle portion and a second outer portion foldably connected to the middle portion;

the at least one opening comprises a first opening and a second opening each extending in at least the middle portion;

the at least one notch comprises a first notch extending in a first outer edge of the article protection insert along the first outer portion and a second notch extending in a second outer edge of the article protection insert along the second outer portion;

the first opening, the second opening, the first notch, and the second notch are spaced apart from one another and are aligned along a length of the article protection insert; and each of the first opening, the second opening, the first notch, and the second notch at least partially receives a respective first article, second article, third article, and fourth article of the plurality of articles in the second position.

18. The carton of claim 1, wherein the two outer portions of the article protection insert comprise a first outer portion foldably connected to the middle portion a and a second outer portion foldably connected to the middle portion, the at least one opening comprises a first opening extending in the middle portion adjacent the first outer portion and a second opening extending in the middle portion adjacent the second outer portion, each of the first opening and the second opening receives at least a portion of a respective first article and second article of the plurality of articles in the second position.

19. The carton of claim 18, wherein the middle portion engages a top surface of each of the first article and the second article.

20. A carton containing a plurality of articles, the carton comprising:

a plurality of panels that extends at least partially around an interior of the carton, the plurality of panels comprising a top panel, a bottom panel, a first side panel, and a second side panel;

an article protection insert comprising a middle portion, two outer portions, and a plurality of features for engaging a respective article of the plurality of articles, the plurality of features comprising at least one opening extending in at least the middle portion and at least one notch extending along at least one of the two outer portions, the at least one notch being spaced apart from the middle portion, and the at least one opening being adjacent a respective one of the two outer portions; and a plurality of access features in the top panel aligning with the middle portion and two outer portions of the article protection insert, and the article protection insert is positionable from a first position wherein the middle portion is coplanar with the two outer portions to a second position wherein the outer portions are folded relative to the middle portion, the at least one opening engages a respective article of the plurality of articles, and the at least one notch engages a respective article of the plurality of articles;

wherein the at least one opening comprises at least a first opening and a second opening extending in at least the middle portion, the first opening and the second opening are spaced apart from one another, and a fold line extends in the middle portion from the first opening to the second opening.

21. In combination, a carton blank and an article protection insert blank for forming a carton for containing a plurality of articles, the carton blank comprising:

a plurality of panels comprising a top panel, a bottom panel, a first side panel, and a second side panel, and a plurality of access features in the top panel for positioning the article protection insert blank; and the article protection insert blank comprising a middle portion, two outer portions and a plurality of features for engaging a respective article of the plurality of articles, the article protection insert blank at least partially overlapping the top panel of the carton blank, the plurality of access features being for positioning the article protection insert blank from a first position wherein the middle portion is coplanar with the two outer portions to a second position wherein the outer portions are folded relative to the middle portion and the plurality of features engages a respective article of the plurality of articles.

22. The combination of claim 21, wherein the plurality of features comprise at least one opening extending at least partially in the middle portion of the article protection insert blank, the at least one opening being for receiving at least a portion of an article of the plurality of articles in the second position.

23. The combination of claim 22, wherein the plurality of features comprise at least one notch in an edge of the article protection insert blank extending along at least one of the two outer portions, the at least one notch being spaced apart from the at least one opening, the at least one notch being for engagement with at least a portion of an article of the plurality of articles in the second position.

24. The combination of claim 21, wherein the plurality of access features comprises a plurality of openings in the top panel.

25. The combination of claim 24, wherein the plurality of openings in the top panel comprise a plurality of cuts.

26. The combination of claim 21, wherein the plurality of features in the middle portion comprises openings for receiving at least a portion of a respective article of the plurality of articles in the second position, and the plurality of features in the two outer portions comprise notches in a respective edge of the article protection insert blank, the notches being for engaging a respective article of the plurality of articles in the second position.

27. The combination of claim 21, wherein the carton blank further comprising dispenser features, the dispenser features comprising a dispenser panel at least partially defined by at least one dispenser pattern extending in at least the top panel, the plurality of access features being in the dispenser panel.

28. The combination of claim 21, wherein the carton blank further comprising at least one article protection flap foldably connected to the bottom panel, the at least one article protection flap is moveable between a first position that is substantially parallel to the bottom panel and a second position wherein the at least one article protection flap is folded relative to the bottom panel.

29. The combination of claim 21, wherein the two outer portions of the article protection insert blank comprise a first outer portion foldably connected to the middle portion along a first fold line and a second outer portion foldably connected to the middle portion along a second fold line.

30. The combination of claim 29, wherein each of the first fold line and the second fold line extends from a first outer edge of the article protection insert blank to an opposing second outer edge of the article protection insert blank.

31. The combination of claim 29, wherein the plurality of features comprises at least a first opening and a second opening extending in at least the middle portion, the first opening and the second opening are spaced apart from one another, and the first fold line extends adjacent the first opening and the second fold line extends adjacent the second fold line opening.

32. The combination of claim 31, wherein the plurality of features further comprises at least a third opening extending at least in the middle portion, the third opening extends adjacent the first fold line and is spaced apart from the first opening, and a third fold line extends in the middle portion from the first opening to the third opening.

33. The combination of claim 21, wherein the plurality of features comprises at least a first opening and a second opening extending in at least the middle portion, the first opening and the second opening are spaced apart from one another, and a fold line extends in the middle portion from the first opening to the second opening.

34. The combination of claim 21, wherein:

the two outer portions of the article protection insert blank comprise a first outer portion foldably connected to the middle portion and a second outer portion foldably connected to the middle portion;

the plurality of features comprises a first opening and a second opening each extending in at least the middle portion, a first notch extending in a first outer edge of the article protection insert blank along the first outer portion, and a second notch extending in a second outer edge of the article protection insert blank along the second outer portion;

the first opening, the second opening, the first notch, and the second notch are spaced apart from one another and are aligned along a length of the article protection insert blank; and the first opening, the second opening, the first notch, and the second notch are for at least partially receiving a respective first article, second article, third article, and fourth article of the plurality of articles in the second position.

* * * * *